US010642207B2

(12) United States Patent
Kaneko et al.

(10) Patent No.: US 10,642,207 B2
(45) Date of Patent: May 5, 2020

(54) IMAGE FORMING APPARATUS

(71) Applicants: Satoshi Kaneko, Kanagawa (JP); Yuuichiroh Uematsu, Kanagawa (JP); Terumichi Ochi, Kanagawa (JP)

(72) Inventors: Satoshi Kaneko, Kanagawa (JP); Yuuichiroh Uematsu, Kanagawa (JP); Terumichi Ochi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/181,668

(22) Filed: Nov. 6, 2018

(65) Prior Publication Data

US 2019/0179246 A1 Jun. 13, 2019

(30) Foreign Application Priority Data

Dec. 12, 2017 (JP) ..... 2017-237924

(51) Int. Cl.

| | |
|---|---|
| ***G03G 15/00*** | (2006.01) |
| ***G03G 15/06*** | (2006.01) |
| ***G03G 15/02*** | (2006.01) |
| ***G03G 15/043*** | (2006.01) |

(52) U.S. Cl.

CPC ..... *G03G 15/5041* (2013.01); *G03G 15/0266* (2013.01); *G03G 15/043* (2013.01); *G03G 15/065* (2013.01); *G03G 15/5058* (2013.01)

(58) Field of Classification Search

CPC ..... G03G 15/043; G03G 15/065; G03G 15/2066; G03G 15/5004; G03G 15/5041; G03G 15/5058

See application file for complete search history.

(56) References Cited

U.S. PATENT DOCUMENTS

| | | | |
|---|---|---|---|
| 2012/0099165 | A1 | 4/2012 | Omori et al. |
| 2012/0201552 | A1 | 8/2012 | Hirai et al. |
| 2014/0169814 | A1 | 6/2014 | Uematsu et al. |
| 2014/0268242 | A1 | 9/2014 | Kaneko et al. |
| 2016/0187807 | A1 | 6/2016 | Hirai et al. |

(Continued)

FOREIGN PATENT DOCUMENTS

| | | |
|---|---|---|
| JP | 9-062042 | 3/1997 |
| JP | 2000-098675 | 4/2000 |

(Continued)

*Primary Examiner* — Thomas S Giampaolo, II

(74) *Attorney, Agent, or Firm* — Oblon, McClelland, Maier & Neustadt, L.L.P.

(57) ABSTRACT

An image forming apparatus includes a latent image bearer, a charger to charge the latent image bearer with a charging bias obtained by superimposing a charge fluctuation voltage to reduce an image density fluctuation on a direct current charging voltage, a writing device to write a latent image on the latent image bearer with writing intensity obtained by superimposing fluctuating writing intensity to reduce an image density fluctuation on constant writing intensity, a developing sleeve to which a developing bias obtained by superimposing a fluctuating developing voltage to reduce an image density fluctuation on a direct current developing voltage is applied to develop the latent image, and circuitry to control the charging bias, the writing intensity, and the developing bias. The circuitry changes the charge fluctuation voltage and the fluctuating developing voltage depending on whether the writing device writes the latent image with the fluctuating writing intensity.

10 Claims, 21 Drawing Sheets

(56) References Cited

U.S. PATENT DOCUMENTS

| | | | |
|---|---|---|---|
| 2017/0248889 | A1 | 8/2017 | Uematsu et al. |
| 2017/0269527 | A1 | 9/2017 | Kaneko et al. |
| 2017/0315471 | A1 | 11/2017 | Kamihara et al. |
| 2018/0136593 | A1 | 5/2018 | Kaneko et al. |
| 2018/0150010 | A1 | 5/2018 | Sone et al. |

FOREIGN PATENT DOCUMENTS

| | | |
|---|---|---|
| JP | 2007-140402 | 6/2007 |
| JP | 2012-088522 | 5/2012 |
| JP | 2012-108454 | 6/2012 |
| JP | 2012-163645 | 8/2012 |
| JP | 2012-237875 | 12/2012 |
| JP | 2014-119713 | 6/2014 |
| JP | 2014-178404 | 9/2014 |
| JP | 2015-143807 | 8/2015 |
| JP | 2016-122180 | 7/2016 |
| JP | 2018-081128 | 5/2018 |

| FIG. 7A |
| --- |
| FIG. 7B |

IMAGE FORMING APPARATUS

CROSS-REFERENCE TO RELATED APPLICATION

This patent application is based on and claims priority pursuant to 35 U.S.C. § 119 to Japanese Patent Application No. 2017-237924, filed on Dec. 12, 2017 in the Japanese Patent Office, the entire disclosure of which is hereby incorporated by reference herein.

BACKGROUND

Technical Field

This disclosure relates to an image forming apparatus.

Description of the Related Art

Conventionally, there are image forming apparatuses that include a charger to charge a surface of a latent image bearer, an exposure device to expose a latent image to the surface of the latent image bearer after charging, a developing device to develop the latent image with developer, and a controller to vary each of a charging bias of the charger, a developing bias of the developing device, and an intensity of the exposure device.

SUMMARY

This specification describes an improved image forming apparatus that includes a latent image bearer, a charger to charge the surface of the latent image bearer with a superimposed charging bias obtained by superimposing a fluctuating charging voltage to reduce an image density fluctuation on a direct current charging voltage, a writing device to write a latent image on the charged surface of the latent image bearer with superimposed writing intensity obtained by superimposing fluctuating writing intensity to reduce an image density fluctuation on constant writing intensity, a developing sleeve to which a superimposed developing bias obtained by superimposing a fluctuating developing voltage to reduce an image density fluctuation on a direct current developing voltage is applied to develop the latent image with developer, and circuitry to control the superimposed charging bias, the superimposed writing intensity, and the superimposed developing bias. The circuitry changes the fluctuating charging voltage and the fluctuating developing voltage between when the writing device writes the latent image with the superimposed writing intensity and when the writing device writes the latent image with the constant writing intensity.

This specification further describes an improved image forming apparatus that includes a latent image bearer, a charger to charge the surface of the latent image bearer with a superimposed charging bias obtained by superimposing a fluctuating charging voltage to reduce an image density fluctuation on a direct current charging voltage, a writing device to write a latent image on the charged surface of the latent image bearer with superimposed writing intensity obtained by superimposing fluctuating writing intensity to reduce an image density fluctuation on constant writing intensity, a developing sleeve to which a superimposed developing bias obtained by superimposing a fluctuating developing voltage to reduce an image density fluctuation on a direct current developing voltage is applied to develop the latent image with developer, and circuitry to control the superimposed charging bias, the superimposed writing intensity, and the superimposed developing bias. The circuitry changes the fluctuating writing intensity between when the fluctuating charging voltage and the fluctuating developing voltage are supplied and when the fluctuating charging voltage and the fluctuating developing voltage are not supplied.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
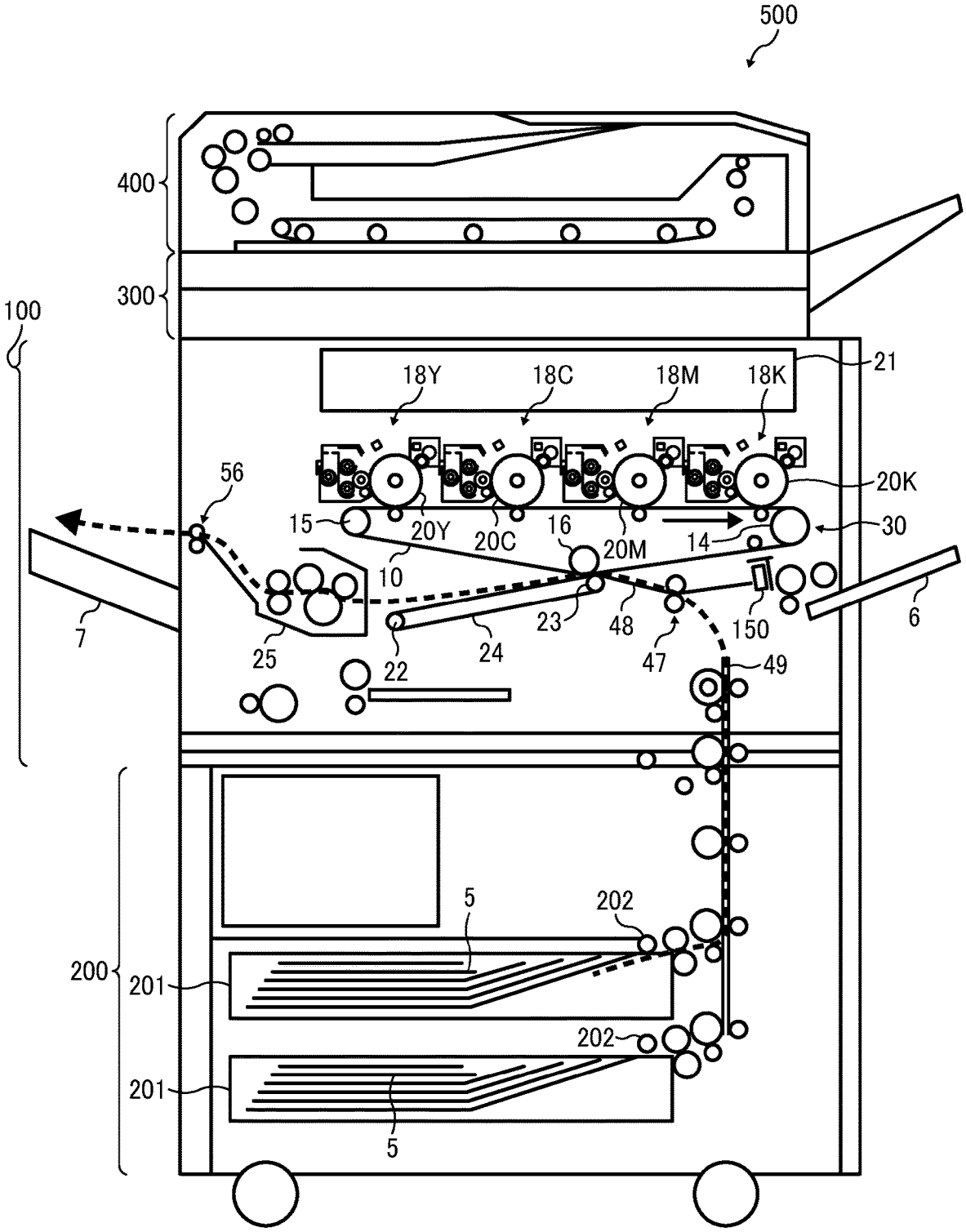
FIG. 1 is a schematic view of an image forming apparatus according to embodiments of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings illustrating the following embodiments, the same reference codes are allocated to elements (members or components) having the same function or shape and redundant descriptions thereof are omitted below.

Descriptions are given below of a basic structure of an image forming apparatus, such as a full-color copier using electrophotography (hereinafter simply "copier"), to which one or more of aspects of the present disclosure are applied, with reference to the drawings, wherein like reference numerals designate identical or corresponding parts throughout the several views thereof, and particularly to FIG. 1, an image forming apparatus employing electrophotography, according to embodiments of the present disclosure is described.

FIG. 1 is a schematic view of a copier 500 according to the present embodiment. As illustrated in FIG. 1, the copier 500 includes an image forming section 100 to form an image on a recording sheet 5, a sheet feeder 200 to supply the recording sheet 5 to the image forming section 100, and a scanner 300 to read an image on a document. In addition, an automatic document feeder (ADF) 400 is disposed above the scanner 300. The image forming section 100 includes a bypass feeder 6 (i.e., a side tray) to feed a recording sheet different from the recording sheets 5 contained in the sheet feeder 200, and a stack tray 7 to stack the recording sheet 5 after an image has been formed thereon.

Figure 2:
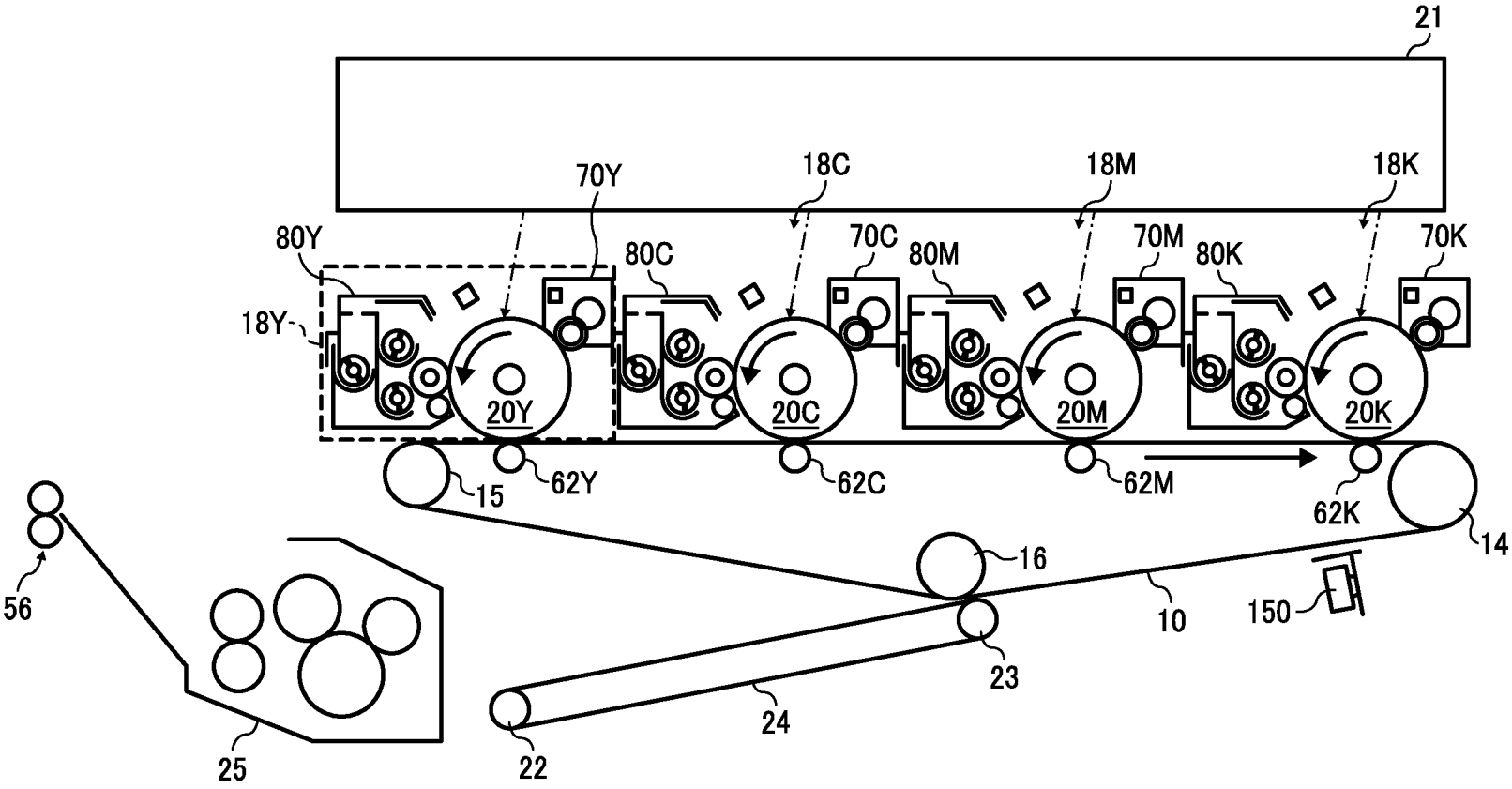
FIG. 2 is an enlarged view illustrating an image forming section of the copier illustrated in FIG. 1.

FIG. 2 is an enlarged view of the image forming section 100. The image forming section 100 includes a transfer unit 30 including an intermediate transfer belt 10 that is an endless belt serving as a transfer member. The intermediate transfer belt 10 of the transfer unit 30 is stretched around three support rollers 14, 15, and 16 and moves endlessly clockwise in FIGS. 1 and 2, as one of the three support rollers rotates. Four image forming units corresponding to yellow (Y), cyan (C), magenta (M), and black (K) are disposed opposite the outer side of a portion of the intermediate transfer belt 10 moving between a first support roller 14 and a second support roller 15 of the support rollers 14, 15, and 16. An optical sensor unit 150 to detect an image density (that is, toner adhesion amount per unit area) of a toner image formed on the intermediate transfer belt 10 is disposed opposite the outer side of the portion of the intermediate transfer belt moving between the first support roller 14 and a third support roller 16. The optical sensor unit 150 serves as an image density detector.

In FIG. 1, a laser writing device 21 serving as a latent image writer is disposed above image forming units 18Y, 18C, 18M, and 18K. The laser writing device 21 emits writing light based on image data of a document read by the scanner 300 or image data sent from an external device such as a personal computer. Specifically, based on the image data, a laser controller drives a semiconductor laser to emit the writing light. The writing light exposes and scans each of the drum-shaped photoconductors 20Y, 20C, 20M, and 20K, serving as latent image bearers, of the image forming units 18Y, 18C, 18M, and 18K, thereby forming an electrostatic latent image thereon. The light source of the writing light is not limited to a laser diode but can be a light-emitting diode (LED), for example.

Figure 3:
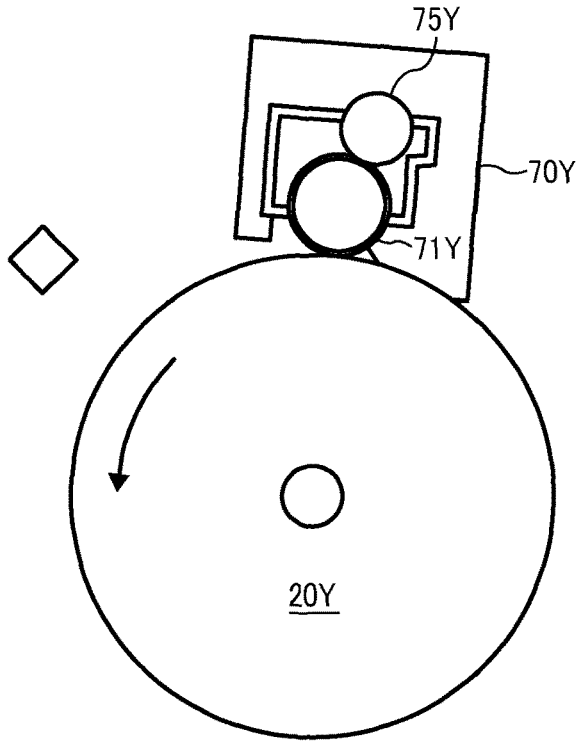
FIG. 3 is an enlarged view illustrating a photoconductor and a charger for yellow toner in the image forming section illustrated in FIG. 2.

FIG. 3 is an enlarged view of the photoconductor 20Y and the charger 70Y for yellow. Components for forming yellow images will be described as representatives. The charger 70Y includes a charging roller 71Y as a charging member that contacts the photoconductor 20Y to rotate following a rotation of the photoconductor 20Y, a charging roller cleaner 75Y that contacts the charging roller 71Y to rotate following a rotation of the charging roller 71Y, and a rotary attitude sensor which is described later.

Figure 4:
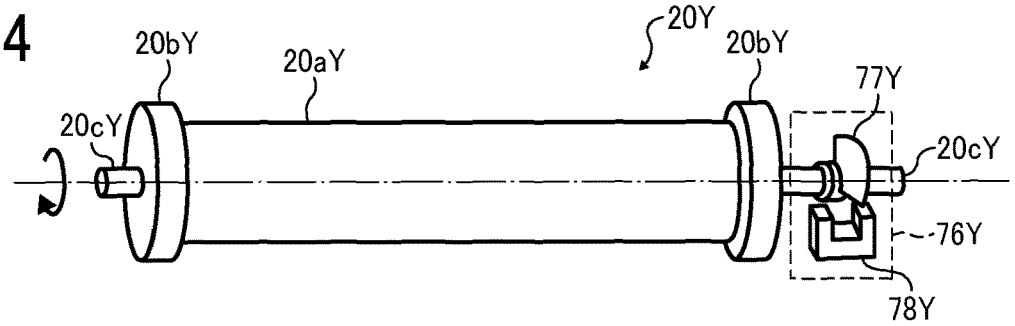
FIG. 4 is an enlarged perspective view illustrating the photoconductor illustrated in FIG. 3.

FIG. 4 is an enlarged perspective view of the photoconductor 20Y for yellow. The photoconductor 20Y includes a columnar body 20*a*Y, large-diameter flanges 20*b*Y disposed at both ends of the columnar body 20*a*Y in the axial direction thereof, and a rotation shaft 20*c*Y rotatably supported by bearings.

One end of the rotation shaft 20*c*Y, which protrudes from the end face of each of the two flanges 20*b*Y, penetrates the photoconductor rotation sensor 76Y, and the portion protruding from the photoconductor rotation sensor 76Y is received by the bearing. The photoconductor rotation sensor 76Y includes a light shield 77Y secured to the rotation shaft 20*c*Y to rotate together with the rotation shaft 20*c*Y, and a transmission photosensor 78Y. The light shield 77Y has a shape protruding from a predetermined position of the rotation shaft 20*c*Y in the direction normal to the rotation shaft 20*c*Y. When the photoconductor 20Y takes a predetermined rotation attitude, the light shield 77Y is interposed between a light-emitting element and a light-receiving element of the transmission photosensor 78Y. With this structure, when the light-receiving element does not receive light, the voltage output from the transmission photosensor 78Y decreases significantly. Specifically, the transmission photosensor 78Y significantly decreases the output voltage detecting the photoconductor 20Y being in a predetermined rotation attitude.

Figure 5:
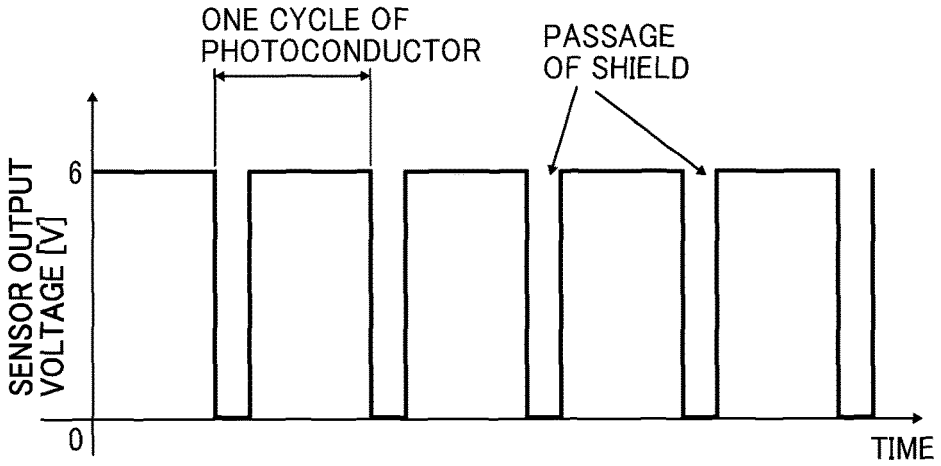
FIG. 5 is a graph illustrating change in output voltage over time from a photoconductor rotation sensor for yellow toner in the image forming section illustrated in FIG. 2.

FIG. 5 is a graph illustrating changes in the output voltage over time from the photoconductor rotation sensor 76Y for yellow. More specifically, the output voltage from the photoconductor rotation sensor 76Y is an output voltage from the transmission photosensor 78Y. As illustrated in FIG. 5, the photoconductor rotation sensor 76Y outputs a predetermined voltage (e.g., 6 volts) most of time during which the photoconductor 20Y rotates. However, each time the photoconductor 20Y makes a complete rotation, the output voltage from the photoconductor rotation sensor 76Y instantaneously falls to nearly 0 volt because, each time the photoconductor 20Y makes a complete rotation, the light shield 77Y is interposed between the light-emitting element and the light-receiving element of the photoconductor rotation sensor 76Y, thus blocking the light to be received by the light-receiving element. Thus, the output voltage drops sharply when the photoconductor 20Y is in a predetermined rotation attitude. Hereinafter, this timing is called "reference attitude timing."

Referring to FIG. 3, the charging roller cleaner 75Y of the charger 70Y includes a conductive cored bar and an elastic layer covering the core bar. The elastic layer, which is a sponge body produced by foaming or expanding melamine resin to have micro pores, rotates while contacting the charging roller 71Y. While rotating, the charging roller cleaner 75Y removes dust, residual toner, and the like from the charging roller 71Y to suppress creation of substandard images.

Referring to FIG. 2, the four image forming units 18Y, 18C, 18M, and 18K are similar in structure, except the color of toner used therein. For example, the image forming unit 18Y to form yellow toner images includes the photoconductor 20Y, the charger 70Y, and a developing device 80Y.

The charger 70Y charges the surface of the photoconductor 20Y uniformly to a negative polarity. Of the uniformly charged surface of the photoconductor 20Y, the portion irradiated with the laser light from the laser writing device 21 has an attenuated potential and becomes an electrostatic latent image.

Figure 6:
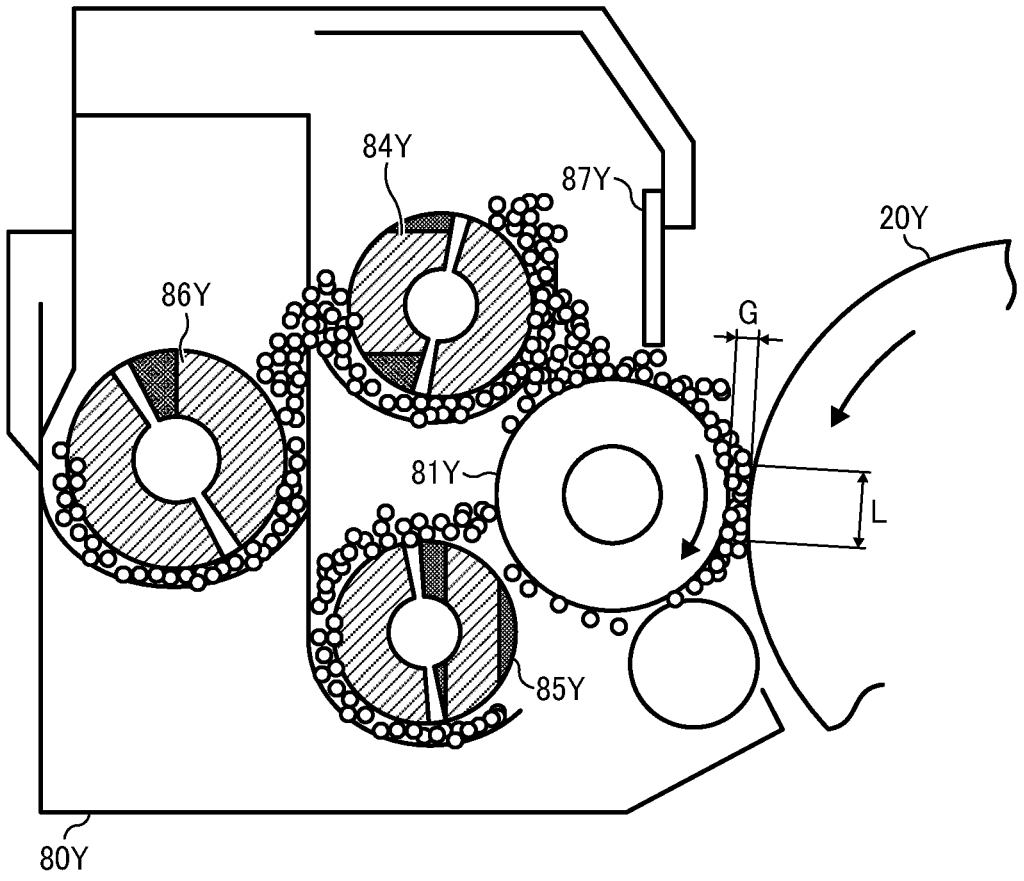
FIG. 6 is a schematic cross-sectional view of a developing device and the photoconductor for yellow toner in the image forming section.

FIG. 6 schematically illustrates the developing device 80Y for yellow and a portion of the photoconductor 20Y for yellow. The developing device 80Y employs two-component development in which two component developer including magnetic carriers and nonmagnetic toner is used for image developing. Alternatively, one-component development using one-component developer that does not include magnetic carriers may be employed. The developing device 80Y includes a stirring section and a developing section within a development case. In the stirring section, the two-component developer (hereinafter, simply "developer") is stirred by three screws (a supply screw 84Y, a collecting screw 85Y, and a stirring screw 86Y) and is conveyed to the developing section.

The developing section includes a rotary developing sleeve 81Y serving as a developing member disposed opposite the photoconductor 20Y via an opening of the development case, across a predetermined development gap G. The developing sleeve 81Y serving as developer bearer includes a magnet roller, which does not rotate together with the developing sleeve 81Y.

The supply screw 84Y and the collecting screw 85Y in the stirring section and the developing sleeve 81Y in the developing section extend in a horizontal direction and are parallel to each other. By contrast, the stirring screw 86Y in the stirring section is inclined to rise from the front side to the backside of the paper on which FIG. 6 is drawn.

While rotating, the supply screw 84Y of the stirring section conveys the developer from the backside to the front side of the paper on which FIG. 6 is drawn to supply the developer to the developing sleeve 81Y of the developing section. The developer that is not supplied to the developing sleeve 81Y but is conveyed to the front end of the development case in the above-mentioned direction falls to the collecting screw 85Y disposed immediately below the supply screw 84Y.

The developer supplied to the developing sleeve 81Y by the supply screw 84Y of the stirring section is scooped up onto the developing sleeve 81Y due to the magnetic force exerted by the magnet roller inside the developing sleeve 81Y. The magnetic force of the magnet roller causes the scooped developer to stand on end on the surface of the developing sleeve 81Y, forming a magnetic brush. As the developing sleeve 81Y rotates, the developer passes through a regulation gap between a leading end of a regulation blade 87Y and the developing sleeve 81Y, where the thickness of a layer of developer on the developing sleeve 81Y is regulated. Then, the developer is conveyed to a developing range opposite the photoconductor 20Y.

In the developing range, the developing bias applied to the developing sleeve 81Y causes a developing potential. The developing potential gives an electrostatic force trending to the electrostatic latent image to the toner of developer located facing the electrostatic latent image on the photoconductor 20Y. In addition, background potential acts on the toner located facing a background portion on the photoconductor 20Y, of the toner in the developer. The background potential gives an electrostatic force trending to the surface of the developing sleeve 81Y. As a result, the toner moves to the electrostatic latent image on the photoconductor 20Y, developing the electrostatic latent image. Thus, a yellow toner image is formed on the photoconductor 20Y. The yellow toner image enters a primary transfer nip for yellow as the photoconductor 20Y rotates.

As the developing sleeve 81Y rotates, the developer that has passed through the developing range reaches an area where the magnetic force of the magnet roller is weaker. Then, the developer leaves the developing sleeve 81Y and returns to the collecting screw 85Y of the stirring section. While rotating, the collecting screw 85Y conveys the developer collected from the developing sleeve 81Y from the backside to the front side of the paper on which FIG. 6 is drawn. At the front end of the developing device 80Y in the above-mentioned direction, the developer is received to the stirring screw 86Y.

While rotating, the stirring screw 86Y conveys the developer received from the collecting screw 85Y to the backside from the front side in the above-mentioned direction. During this process, a toner concentration sensor 82Y, which may be a magnetic permeability sensor (and is described later referring to FIGS. 7A and 7B), detects the concentration of toner. Based on the reading, toner is supplied as required. Specifically, to supply toner, a controller 110 (illustrated in FIGS. 7A and 7B) drives a toner supply device according to the readings of the toner concentration sensor. The developer to which the toner is thus supplied is conveyed to the back end of the development case in the above-mentioned direction and is received by the supply screw 84Y.

Although the description above concerns formation of yellow images in the image forming unit 18Y, in the image forming units 18C, 18M, and 18K, cyan, magenta, and black toner images are formed on the photoconductors 20C, 20M, and 20K, respectively, through similar processes.

In FIG. 2, primary transfer rollers 62Y, 62C, 62M, and 62K are disposed inside the loop of the intermediate transfer belt 10 and nip the intermediate transfer belt 10 together with the photoconductors 20Y, 20C, 20M, and 20K. Accordingly, the outer face (front side) of the intermediate transfer belt 10 contacts the photoconductors 20Y, 20M, 20C, and 20K, and the contact portions therebetween serve as primary transfer nips for yellow, magenta, cyan, and black, respectively. Primary electrical fields are respectively generated between the photoconductors 20Y, 20C, 20M, and 20K and the primary transfer rollers 62Y, 62C, 62M, and 62K in which the primary transfer bias is applied.

The outer face of the intermediate transfer belt 10 sequentially passes the primary transfer nips for yellow, cyan, magenta, and black as the intermediate transfer belt 10 rotates. During such a process, yellow, magenta, cyan, and black toner images are sequentially transferred from the photoconductors 20Y, 20C, 20M, and 20K and superimposed on the outer face of the intermediate transfer belt 10 (i.e., primary transfer process). Thus, a four-color superimposed toner image is formed on the outer face of the intermediate transfer belt 10.

Below the intermediate transfer belt 10, an endless conveyor belt 24 is stretched around a first tension roller 22 and a second tension roller 23. The conveyor belt 24 rotates counterclockwise in the drawing as one of the tension rollers 22 and 23 rotates. The outer face of the conveyor belt 24 contacts a portion of the intermediate transfer belt 10 winding around the third support roller 16, and the contact portion therebetween is called "secondary transfer nip." Around the secondary transfer nip, a secondary transfer electrical field is generated between the second tension roller 23, which is grounded, and the third support roller 16, to which a secondary transfer bias is applied.

Referring back to FIG. 1, the image forming section 100 includes a conveyance path 48, through which the recording sheet 5 fed from the sheet feeder 200 or the bypass feeder 6 is sequentially transported to the secondary transfer nip, a fixing device 25 described later, and an ejection roller pair 56. The image forming section 100 includes another conveyance path 49 to convey the recording sheet 5 fed to the image forming section 100 from the sheet feeder 200 to an entrance of the conveyance path 48. A registration roller pair 47 is disposed at the entrance of the conveyance path 48.

When a print job is started, the recording sheet 5, fed from the sheet feeder 200 or the bypass feeder 6, is conveyed to the conveyance path 48. The recording sheet 5 then abuts against the registration roller pair 47. The registration roller pair 47 starts rotation at a proper timing, thereby sending the recording sheet 5 toward the secondary transfer nip. In the secondary transfer nip, the four-color superimposed toner image on the intermediate transfer belt 10 tightly contacts the recording sheet 5. The four-color superimposed toner image is secondarily transferred en bloc onto the surface of the recording sheet 5 due to effects of the secondary transfer electrical field and nip pressure. Thus, a full-color toner image is formed on the recording sheet 5.

The conveyor belt 24 conveys the recording sheet 5 that has passed through the secondary transfer nip to the fixing device 25. The recording sheet 5 is pressed and heated inside the fixing device 25, thereby the full-color toner image is fixed on the surface of the recording sheet 5. After discharged from the fixing device 25, the recording sheet 5 is conveyed to the ejection roller pair 56 and ejected onto the stack tray 7.

Figures 7, 7A:
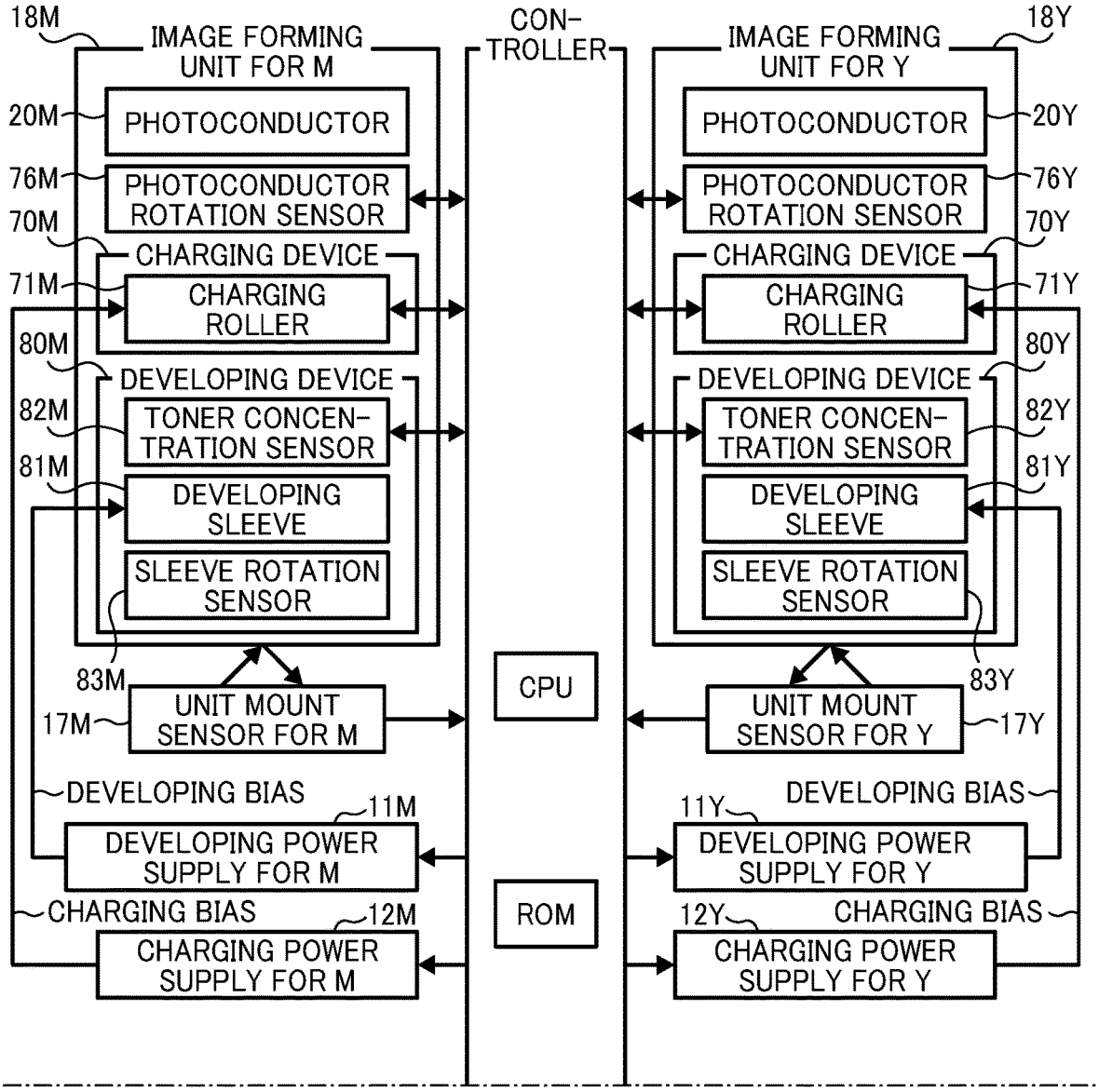
FIGS. 7A and 7B (collectively referred to as FIG. 7) are block diagrams illustrating circuitry of the image forming apparatus illustrated in FIG. 1.
Figure 7B:
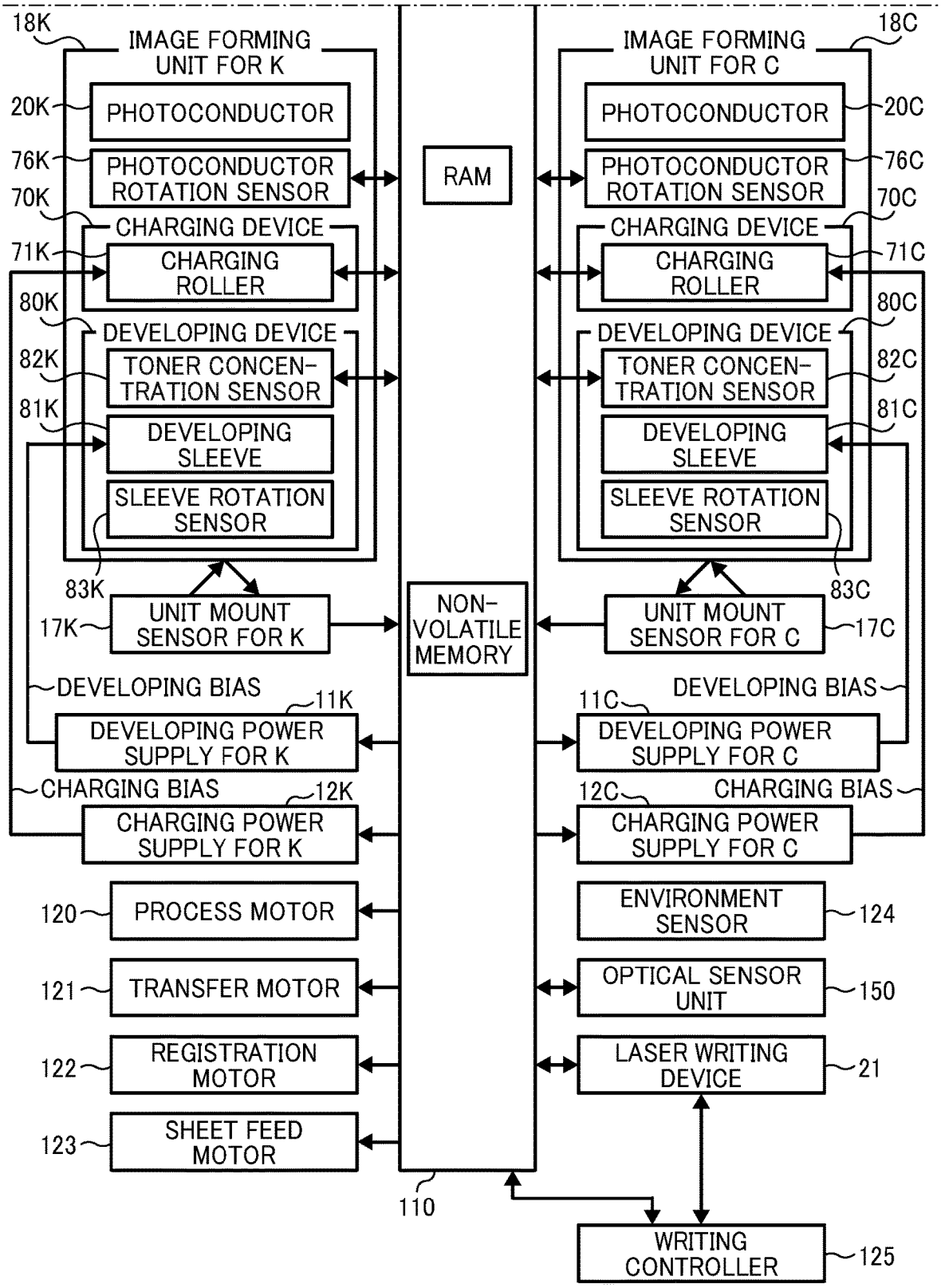

FIGS. 7A and 7B are block diagrams illustrating circuitry of the copier 500 according to the present embodiment. In the configuration illustrated in FIGS. 7A and 7B, the controller 110 includes a central processing unit (CPU), a random-access memory (RAM), a read only memory (ROM), a nonvolatile memory, and the like. The controller 110 is electrically connected to the toner concentration sensors 82Y, 82C, 82M, and 82K of the yellow, cyan, magenta, and black developing devices 80Y, 80C, 80M, and 80K, respectively. With this structure, the controller 110 obtains the toner concentration of yellow developer, cyan developer, magenta developer, and black developer contained in the developing devices 80Y, 80C, 80M, and 80K, respectively.

Unit mount sensors 17Y, 17C, 17M, and 17K for yellow, cyan, magenta, and black, serving as replacement detectors, are also electrically connected to the controller 110. The unit mount sensors 17Y, 17C, 17M, and 17K respectively detect removal of the image forming units 18Y, 18C, 18M, and 18K from the image forming section 100 and mounting thereof in the image forming section 100. With this structure, the controller 110 recognizes that the image forming units 18Y, 18C, 18M, and 18K have been mounted in or removed from the image forming section 100.

In addition, developing power supplies 11Y, 11C, 11M, and 11K for yellow, cyan, magenta, and black are electrically connected to the controller 110. The controller 110 outputs control signals to the developing power supplies 11Y, 11C, 11M, and 11K respectively, to adjust the value of developing bias output from each of the developing power supplies 11Y, 11C, 11M, and 11K. That is, the values of developing biases applied to the developing sleeves 81Y, 81C, 81M, and 81K for yellow, cyan, magenta, and black can be individually adjusted.

In addition, charging power supplies 12Y, 12C, 12M, and 12K for yellow, cyan, magenta, and black are electrically connected to the controller 110. The controller 110 outputs control signals to the charging power supplies 12Y, 12C, 12M, and 12K, respectively, to adjust the value of direct current (DC) voltage in the charging bias output from each of the charging power supplies 12Y, 12C, 12M, and 12K, individually. That is, the values of direct current voltage in the charging biases applied to the charging rollers 71Y, 71C, 71M, and 71K for yellow, cyan, magenta, and black can be individually adjusted.

In addition, the photoconductor rotation sensors 76Y, 76C, 76M, and 76K to individually detect the photoconductors 20Y, 20C, 20M, and 20K for yellow, cyan, magenta, and black being in the predetermined rotation attitude are electrically connected to the controller 110. Accordingly, based on the detection output from the photoconductor rotation sensors 76Y, 76C, 76M, and 76K, the controller 110 individually recognizes whether or not each of the photoconductors 20Y, 20C, 20M, and 20K for yellow, cyan, magenta, and black is in the predetermined rotation attitude.

Sleeve rotation sensors 83Y, 83C, 83M, and 83K of the developing devices 80Y, 80C, 80M, and 80K, respectively, are also electrically connected to the controller 110. The sleeve rotation sensors 83Y, 83C, 83M, and 83K, each serving as a rotation attitude sensor, are similar in structure to the photoconductor rotation sensors 76Y, 76C, 76M, and 76K and configured to detect the developing sleeves 81Y, 81C, 81M, and 81K being in predetermined rotation attitudes, respectively. In other words, based on the detection output from the sleeve rotation sensors 83Y, 83C, 83M, and 83K, the controller 110 individually recognizes the timing at which each of the developing sleeves 81Y, 81C, 81M, and 81K takes the predetermined rotation attitude.

In addition, a writing controller 125, an environment sensor 124, the optical sensor unit 150, a process motor 120, a transfer motor 121, a registration motor 122, a sheet feeding motor 123, and the like are electrically connected to the controller 110. The environment sensor 124 detects the temperature and the humidity inside the apparatus. The process motor 120 is a driving source for the image forming units 18Y, 18C, 18M, and 18K. The transfer motor 121 is a driving source for the intermediate transfer belt 10. The registration motor 122 is a driving source for the registration roller pair 47. The sheet feeding motor 123 is a driving source to drive pickup rollers 202 to send out the recording sheet 5 from sheet trays 201 of the sheet feeder 200. The writing controller 125 controls driving of the laser writing device 21 based on the image data. The function of the optical sensor unit 150 is described later.

The copier 500 according to the present embodiment performs a control operation called "process control" regularly at predetermined timings to stabilize the image density over a long time regardless of environmental changes or the like. In the process control, a yellow patch pattern image (a toner image) including multiple patch-shaped yellow toner images (i.e., toner patches) is formed on the photoconductor 20Y and transferred onto the intermediate transfer belt 10. Each of the patch-shaped yellow toner images is used for detecting the amount of yellow toner adhering. The controller 110 similarly forms cyan, magenta, and black patch pattern images on the photoconductors 20C, 20M, and 20K, respectively, and transfers the patch pattern images onto the intermediate transfer belt 10 so as not to overlap. Then, the optical sensor unit 150 detects a toner adhesion amount of each toner patch in the patch pattern image of each color. Subsequently, based on the readings obtained, image forming conditions, such as a developing bias reference value being a reference value of the developing bias Vb, are adjusted individually for each of the image forming units 18Y, 18C, 18M, and 18K.

The optical sensor unit 150 includes four reflective photosensors aligned in the width direction of the intermediate transfer belt 10, which is hereinafter referred to as "belt width direction," at predetermined intervals. Each reflective photosensor outputs a signal corresponding to the reflectance light on the intermediate transfer belt 10 or the patch-shaped toner image on the intermediate transfer belt 10. Three of the four reflective photosensors capture both specular reflection light and diffuse reflection light on the belt surface and output signals according to the amount luminous energy so that the output signal corresponds to the adhesion amount of the corresponding one of yellow, magenta, and cyan toners.

Figure 8:
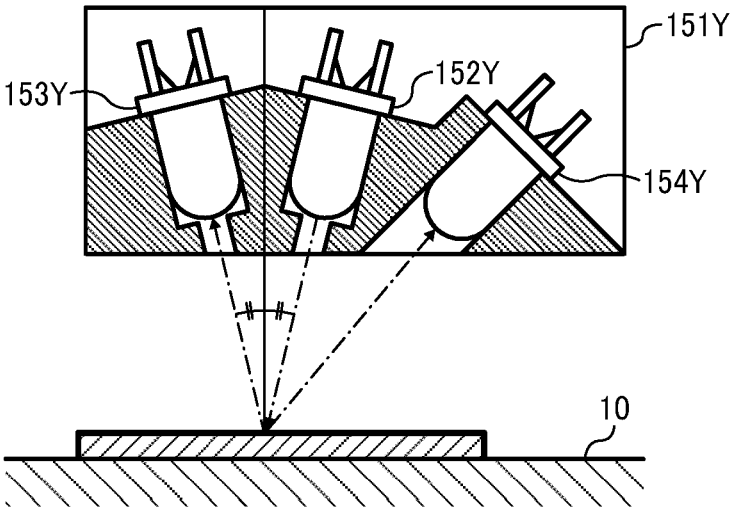
FIG. 8 is an enlarged view of a reflective photosensor for yellow mounted on an optical sensor unit of the image forming apparatus illustrated in FIG. 1.

FIG. 8 is an enlarged view of a reflective photosensor 151Y for yellow mounted in the optical sensor unit 150. The reflective photosensor 151Y includes a light-emitting diode (LED) 152Y as a light source, a light-receiving element 153Y that receives the specular reflection light, and a light-receiving element 154Y that receives the diffused reflection light. The light-receiving element 153Y outputs a voltage corresponding to the amount of specular reflection light on the surface of the yellow toner patch (patch-shaped toner image). The light-receiving element 154Y outputs a voltage corresponding to the amount of diffuse reflection light on the surface of the yellow toner patch (patch-shaped toner image). The controller 110 calculates the adhesion amount of yellow toner of the yellow toner patch based on the output voltage. The reflective photosensors 151C and 151M for cyan and magenta are similar in structure to the reflective photosensor 151Y for yellow described above.

Figure 9:
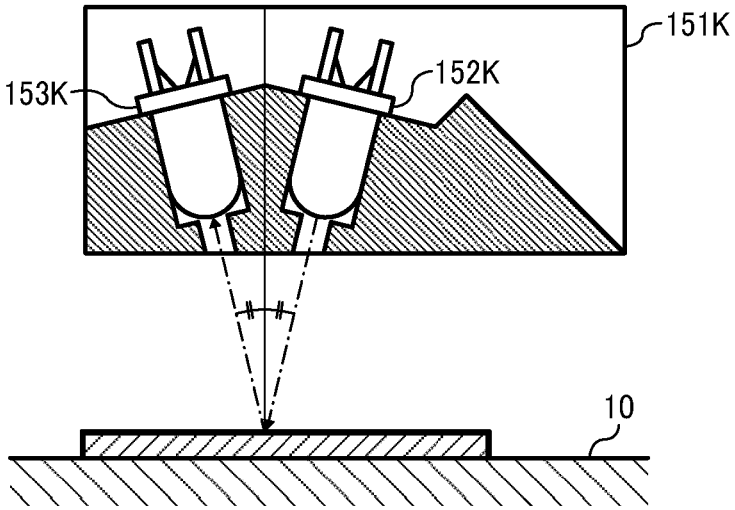
FIG. 9 is an enlarged view of a reflective photosensor for black mounted on the optical sensor unit illustrated in FIG. 8.

FIG. 9 is an enlarged view of a reflective photosensor 151K for black, mounted in the optical sensor unit 150. The reflective photosensor 151K includes an LED 152K, serving as a light source, and a light-receiving element 153K that receives specular reflection light. The light-receiving element 153K outputs a voltage corresponding to the amount of specular reflection light on the surface of the black toner patch. The controller 110 calculates the toner adhesion amount of the black toner patch based on the output voltage.

In the present embodiment, the LED 152Y, 152C, 152M, and 152K employ a gallium arsenide (GaAs) infrared light-emitting diode to emit light having a peak wavelength of 950 nm. For the light-receiving elements 153Y, 153C, 153M, and 153K to receive specular reflection and the light-receiving elements 154Y, 154C, 154M and 154K to receive diffuse reflection, silicon (Si) photo transistors having a peak light receiving sensitivity of 800 nm are used. However, the peak wavelength and the peak light receiving sensitivity are not limited to the values mentioned above.

The four reflective photosensors are disposed approximately 5 millimeters from the outer face of the intermediate transfer belt 10.

The controller 110 performs the process control at a predetermined timing, such as, turning on of a main power, standby time after elapse of a predetermined period, and standby time after printing on a predetermined number of sheets or greater. When the process control is started, initially, the controller 110 obtains information such as the number of sheets fed, coverage rate, and environmental information such as temperature and humidity, and the controller 110 ascertains individual development properties in the image forming units 18Y, 18C, 18M, and 18K. Specifically, the controller 110 calculates development y and development threshold voltage for each color. More specifically, the controller 110 causes the chargers 70Y, 70C, 70M, and 70K to uniformly charge the photoconductors 20Y, 20C, 20M, and 20K while rotating the photoconductors 20. In the charging, the charging power supplies 12Y, 12C, 12M, and 12K output charging biases different from those for normal printing. More specifically, of the charging bias, which is a superimposed bias including the direct current voltage and the alternating current voltage, the direct current voltage is not kept constant but is gradually increased in absolute value. The laser writing device 21 scans, with the laser light, the photoconductors 20Y, 20C, 20M, and 20K charged under such conditions, to form a plurality of electrostatic latent images for the patch-shaped toner image of yellow, cyan, magenta, and black. The developing devices 80Y, 80C, 80M, and 80K develop the latent images thus formed, respectively, to form the patch pattern images of yellow, cyan, magenta, and black on the photoconductors 20Y, 20C, 20M, and 20K. In the developing process, the controller 110 gradually increases the absolute value of each of developing biases applied to the developing sleeves 81Y, 81C, 81M, and 81K. At that time, the developing potential for each patch-shaped toner image, which is the difference between the developing bias and the electrostatic latent image potential of each patch-shaped toner image, is stored in the RAM.

Figure 10:
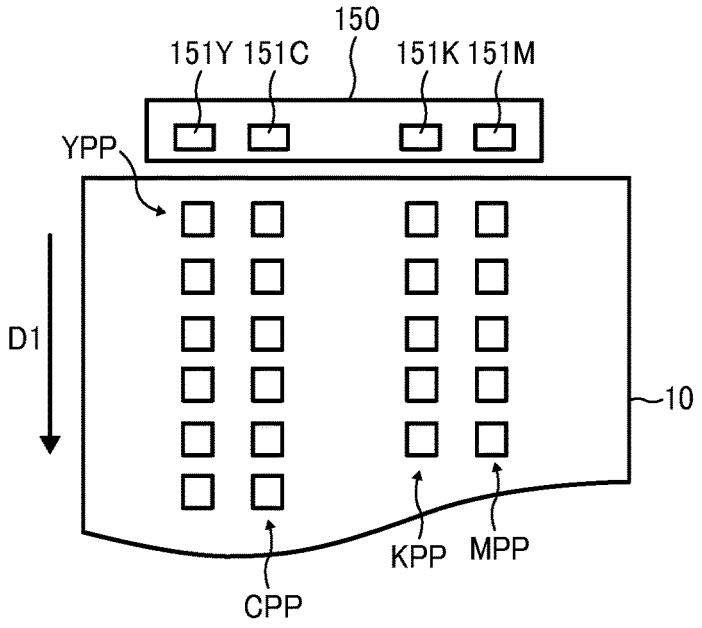
FIG. 10 illustrates a patch pattern image for each color transferred onto an intermediate transfer belt, according to embodiments of the present disclosure.

As illustrated in FIG. 10, patch pattern images YPP, CPP, MPP, and KPP of yellow, cyan, magenta, and black (collectively "patch pattern images PP") are arranged in the belt width direction so as not to overlap on the intermediate transfer belt 10. Specifically, the patch pattern image YPP is disposed on a first end side (on the left in FIG. 10) of the intermediate transfer belt 10 in the belt width direction. The patch pattern image CPP is disposed at a position shifted to a center from the patch pattern image YPP in the belt width direction. The patch pattern image MPP is disposed on a second end side (on the right in FIG. 10) of the intermediate transfer belt 10 in the belt width direction. The patch pattern image KPP is disposed at a position shifted to the center from the patch pattern image MPP in the belt width direction.

The optical sensor unit 150 includes the reflective photosensor 151Y for yellow, the reflective photosensor 151C for cyan, the reflective photosensor 151K for black, and the reflective photosensor 151M for magenta to detect the light reflection characteristics of the intermediate transfer belt 10 at different positions in the belt width direction that is a main scanning direction. The reflective photosensor 151Y is disposed to detect the amount of toner adhering to the yellow toner patches in the patch pattern image YPP on the first end side of the intermediate transfer belt 10 in the belt width direction. The reflective photosensor 151C is disposed to detect the amount of toner adhering to the cyan toner patches in the patch pattern image CPP close to the toner patch pattern YPP in the belt width direction. The reflective photosensor 151M is disposed to detect the amount of toner adhering to the magenta toner patches in the patch pattern image MPP on the second end side of the intermediate transfer belt 10 in the belt width direction. The reflective photosensor 151K is disposed to detect the amount of toner adhering to the black toner patches of the patch pattern image KPP close to the patch pattern image MPP in the belt width direction.

Based on the signals sequentially output from the four reflective photosensors (151Y, 151C, 151M, and 151K) of the optical sensor unit 150, the controller 110 calculates the reflectance of light of the toner patches of four colors, obtains the amount of toner adhering (i.e., toner adhesion amount) to each toner patch based on the computation result, and stores the calculated toner adhesion amounts in the RAM. After passing the optical sensor unit 150 as the intermediate transfer belt 10 rotates, the toner patch patterns PP are removed from the intermediate transfer belt 10 by a cleaning device.

Figure 11:
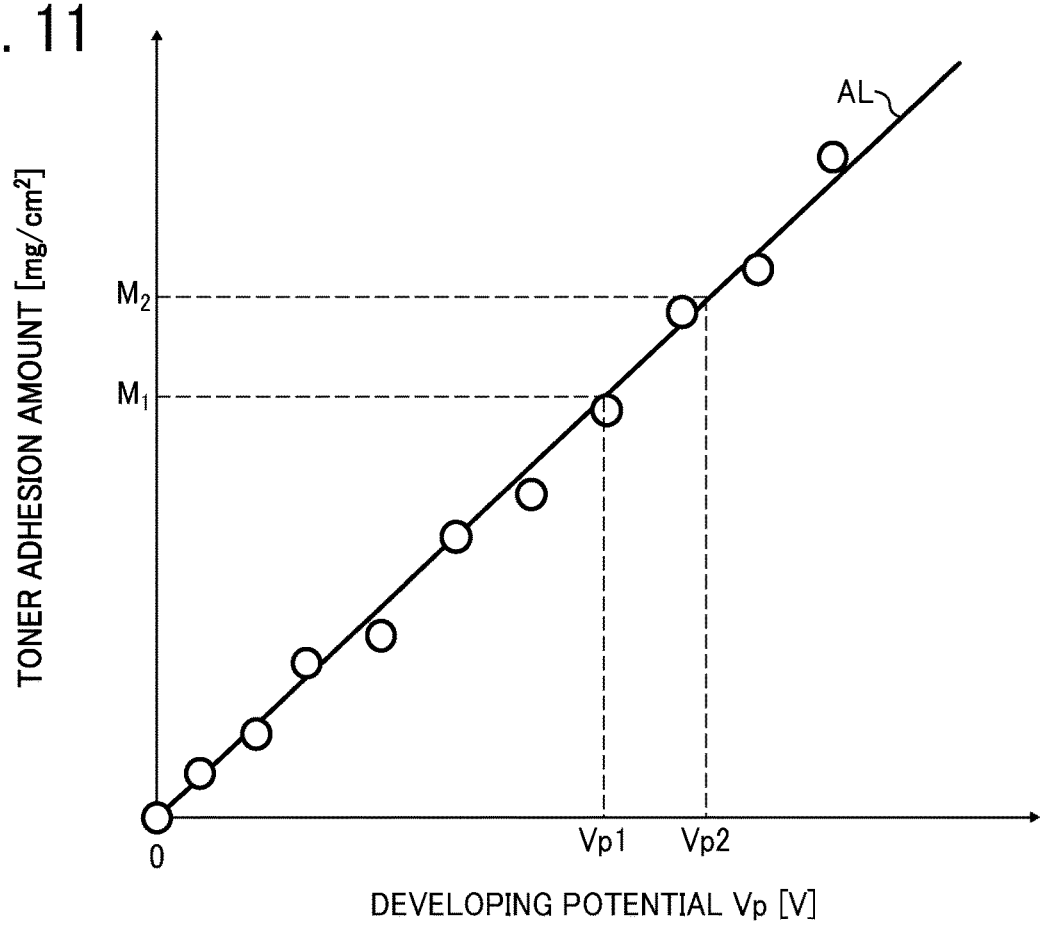
FIG. 11 is a graph of an approximation line representing a relation between toner adhesion amount and developing bias, which is generated in process control.

The controller 110 calculates a linear approximation formula $Y=a\times Vp+b$, based on the toner adhesion amount stored in the RAM and data on the latent image potential and developing bias Vb regarding each toner patch stored in the RAM separately from the toner adhesion amount. Specifically, controller 110 calculates a formula of approximate straight line (AL in FIG. 11) representing the relation between the toner adhesion amount (Y-axis) and the developing potential (X-axis) in X−Y coordinate, as illustrated in FIG. 11. Based on the formula for an approximate straight line, the controller 110 obtains a developing potential Vp (e.g., Vp1 or Vp2 in FIG. 11) to achieve a target toner adhesion amount (e.g., $M_1$ or $M_2$ in FIG. 11) and further obtains the developing bias reference value and the charging bias reference value (and a laser diode power or an LD power) to achieve the developing potential Vp. The obtained results are stored in the nonvolatile memory. The controller 110 performs calculation and recording of the developing bias reference value and the charging bias reference value (and a reference LD power) for each of yellow, cyan, magenta, and black and terminates the process control. Thereafter, when the controller 110 runs a print job, the controller 110 causes the developing power supplies 11Y, 11C, 11M, and 11K to output the developing biases Vb based on the developing bias reference value stored, for each of yellow, cyan, magenta, and black, in the nonvolatile memory. In addition, the controller 110 causes the charging power supplies 12Y, 12C, 12M, and 12K to output the charging bias Vd based on the charging bias reference value stored in the nonvolatile memory and causes the laser writing device 21 to output the LD power.

The controller 110 performs the above-described process control to determine the developing bias reference value, the charging bias reference value, and the optical writing intensity (or LD power to be described later) to attain the target toner adhesion amount, thereby stabilizing the image density of the whole image regarding each of yellow, cyan, magenta, and black for a long period. However, it is possible that, as the development gap between the photoconductor 20 (20Y, 20C, 20M, and 20K) and the developing sleeve 81 (81Y, 81C, 81M, and 81K) fluctuates (hereinafter "gap fluctuation"), image density fluctuates cyclically even within a single page.

In the image density fluctuation, image density fluctuation occurring with the rotation cycle of the photoconductors 20Y, 20C, 20M, and 20K and image density fluctuation occurring with the rotation cycle of the developing sleeves 81Y, 81C, 81M, and 81K are superimposed. Specifically, if the rotation axis of the photoconductor 20 (20Y, 20C, 20M, or 20K) is eccentric, the eccentricity causes gap fluctuations drawing a variation curve shaped similarly per photoconductor rotation. As a result, in the developing electrical field generated between the photoconductor 20 (20Y, 20C, 20M, or 20K) and the developing sleeve 81 (81Y, 81C, 81M, or 81K), the strength of the field fluctuates, drawing a variation curve shaped similarly for each round of the photoconductor 20. Fluctuations in electrical field strength cause the image density fluctuation that draws a similar pattern per photoconductor rotation cycle. Further, the external shape of the photoconductor tends to have distortion. The distortion results in cyclic gap fluctuation drawing same patterns per photoconductor rotation, which cause image density fluctuation. Further, eccentricity or distortion of the external shape of the developing sleeve 81 (81Y, 81C, 81M, or 81K) causes gap fluctuation in the cycle of rotation of the developing sleeve 81 (hereinafter "sleeve rotation cycle") and results in cyclic image density fluctuation. In particular, since the image density fluctuation due to the eccentricity or distortion in the shape of the developing sleeve 81, which is smaller in diameter than the photoconductors 20, occurs in relatively short cycle, such image density fluctuation is more noticeable.

In view of the foregoing, in performing print jobs, the controller 110 performs a first fluctuation control for each of yellow, cyan, magenta, and black as follows. Specifically, for each of yellow, cyan, magenta, and black, the controller 110 stores, in the nonvolatile memory, a first pattern data of the developing bias to cause changes in the developing electrical field strength capable of offsetting the image density fluctuation occurring in the cycle of photoconductor rotation. The controller 110 further stores, in the nonvolatile memory, a first pattern data of the developing bias to cause changes in the developing electrical field strength capable of offsetting the image density fluctuation occurring in sleeve rotation cycle. Hereinafter, the former first pattern data is referred to as "a first pattern data for photoconductor cycle." The latter first pattern data is also referred to as "a first pattern data for sleeve cycle." Based on these first pattern data, the developing bias changes in a predetermined voltage fluctuation pattern.

The first pattern data for photoconductor cycle, which is generated individually for yellow, magenta, cyan, and black, is a pattern for one rotation cycle of the photoconductor, and the pattern is made with reference to the reference attitude timing of the photoconductor 20. The first pattern data is used to change the output of the developing bias from the developing power supplies (11Y, 11C, 11M, and 11K) based on the developing bias reference values for yellow, cyan, magenta, and black determined in the process control. For example, in the case of data table format, the first pattern includes a group of data on differences in the output developing bias at predetermined intervals in a period equivalent to one rotation cycle starting from the reference attitude timing. Leading data in the data group represents the developing bias output difference at the reference attitude timing, and second data, third data, and fourth data to later data represent the developing bias output differences at the predetermined intervals subsequent to the reference attitude timing. For example, an output pattern formed of a group of data κ, −5, −7, −9, . . . represents that the developing bias output differences are 0 V, −5 V, −7 V, −9 V . . . at predetermined intervals, respectively.

To minimize the image density fluctuation occurring in photoconductor rotation cycle, the developing power supply 11 outputs the developing bias in which the developing bias output difference which is referred to as a fluctuating developing voltage is superimposed on the developing bias reference value. In the copier 500 according to the present embodiment, additionally, to suppress the image density fluctuation in sleeve rotation cycle as well, the developing bias output difference to suppress the image density fluctuation in photoconductor rotation cycle and the developing bias output difference to suppress the image density fluctuation in sleeve rotation cycle are superimposed on the developing bias reference value.

The first pattern data for sleeve cycle, which is generated individually for yellow, magenta, cyan, and black, is a pattern for one rotation cycle in each of the developing sleeves 81Y, 81C, 81M, and 81K, and the pattern is made with reference to the reference attitude timing of each of the developing sleeves 81Y, 81C, 81M, and 81K. The first pattern data is used to change the output of the developing bias from the developing power supplies (11Y, 11C, 11M, and 11K) based on the developing bias reference values for yellow, cyan, magenta, and black determined in the process control (i.e., reference value determination process). In the case of data table format, leading data in the data group represents the developing bias output difference at the reference attitude timing, and second data, third data, and fourth data to later data represent the developing bias output differences at the predetermined intervals subsequent to the reference attitude timing. The predetermined intervals are identical to the intervals reflected in the data group in the developing-bias change pattern for photoconductor cycle.

In an image forming process, the controller 110 in FIGS. 7A and 7B reads the data from the first pattern data for photoconductor cycle, which individually corresponds to yellow, cyan, magenta, and black, at the predetermined intervals. Simultaneously, the controller 110 also reads the data of the first pattern data for sleeve cycle, which individually corresponds to yellow, cyan, magenta, and black, at the identical predetermined intervals. In reading the data, in the case where the reference attitude timing does not arrive even after the last data of the data group is read, the controller 110 sets the read value identical to the last data until the reference attitude timing arrives. In the case where the reference attitude timing arrives before the last data of the data group is read, the data read position is returned to the initial data. Regarding the reading of data from the first pattern data for photoconductor cycle, a timing at which each of the photoconductor rotation sensors 76Y, 76C, 76M, and 76K (See FIG. 4) transmits the reference attitude timing signal is used as the reference attitude timing. Regarding the reading of data from the first pattern data for sleeve cycle, a timing at which each of the sleeve rotation sensors 83Y, 83C, 83M, and 83K transmits the reference attitude timing signal is used as the reference attitude timing.

For each of yellow, cyan, magenta, and black, in such a data reading process, the data read from the first pattern data for photoconductor cycle and that from the first pattern data for sleeve cycle are added together to calculate the superimposed value. For example, when the data read from the first pattern data for photoconductor cycle indicates −5 V and the data read from the first pattern data for sleeve cycle indicates 2 V, −5 V and 2 V are added together. Then, the superimposed value is −3 V. When the developing bias reference value is −550 V, the result of addition of the superimposed value is −553 V, which is output from the developing power supply 11. Such processing is performed for each of yellow, cyan, magenta, and black at the predetermined intervals.

With this process, the developing electrical field between the photoconductor 20 and the developing sleeve 81 is varied in strength to offset an electrical field strength variation that is a superimposition of two types of variations in the electrical field strength, namely, (1) electrical field strength variation caused by the gap fluctuation in photoconductor rotation cycle, due to eccentricity or distortion in the external shape of the photoconductor 20, and (2) electrical field strength variation in sleeve rotation cycle due to eccentricity or distortion in the external shape of the developing sleeve 81. With such process, regardless of the rotation attitude of the photoconductor 20 and that of the developing sleeve 81, the developing electrical field between the photoconductor 20 and the developing sleeve 81 can be kept substantially constant. This process can suppress the image density fluctuation occurring in both of the photoconductor rotation cycle and the sleeve rotation cycle. The above process is the first fluctuation control.

The first pattern data for photoconductor cycle and the one for sleeve cycle, which individually corresponds to each of yellow, cyan, magenta, and black, are generated by executing a first detection process and a first pattern process at predetermined timings. Examples of the predetermined timing of the first detection process are as follows. That is, the predetermined timing includes a timing before a first print job and after shipping from factory (hereinafter called an initial startup timing), a replacement detection timing when a replacement of any one of the image forming units 18Y, 18C, 18M, and 18K is detected, and a timing of environmental change at which environmental change from the previous first detection process exceeds a threshold.

At the initial startup timing and the timing of environmental change, the controller 110 generates the first pattern data for photoconductor cycle and the first pattern data for sleeve cycle, for each of yellow, cyan, magenta, and black. In contrast, in the replacement detection timing, only for the image forming unit 18, replacement of which is detected, the controller 110 generates the first pattern data for photoconductor cycle and the first pattern data for sleeve cycle. To enable the generation of pattern, as illustrated in FIGS. 7A and 7B, the copier 500 includes the unit mount sensors 17Y, 17C, 17M, and 17K to individually detect the replacement of the image forming units 18Y, 18C, 18M, and 18K.

The controller 110 according to the present embodiment uses the amount of change in absolute humidity as the environmental change. The controller 110 calculates the absolute humidity based on temperature detected by the environment sensor 124 and relative humidity detected by the environment sensor 124. The absolute humidity calculated in the previous pattern process is stored. Subsequently, the controller 110 regularly calculates the absolute humidity based on the readings on temperature and humidity, detected by the environment sensor 124. When the difference (environmental change amount) between the calculated value and the stored absolute humidity exceeds the threshold, the controller 110 executes the first detection process and the first pattern process.

Figure 12:
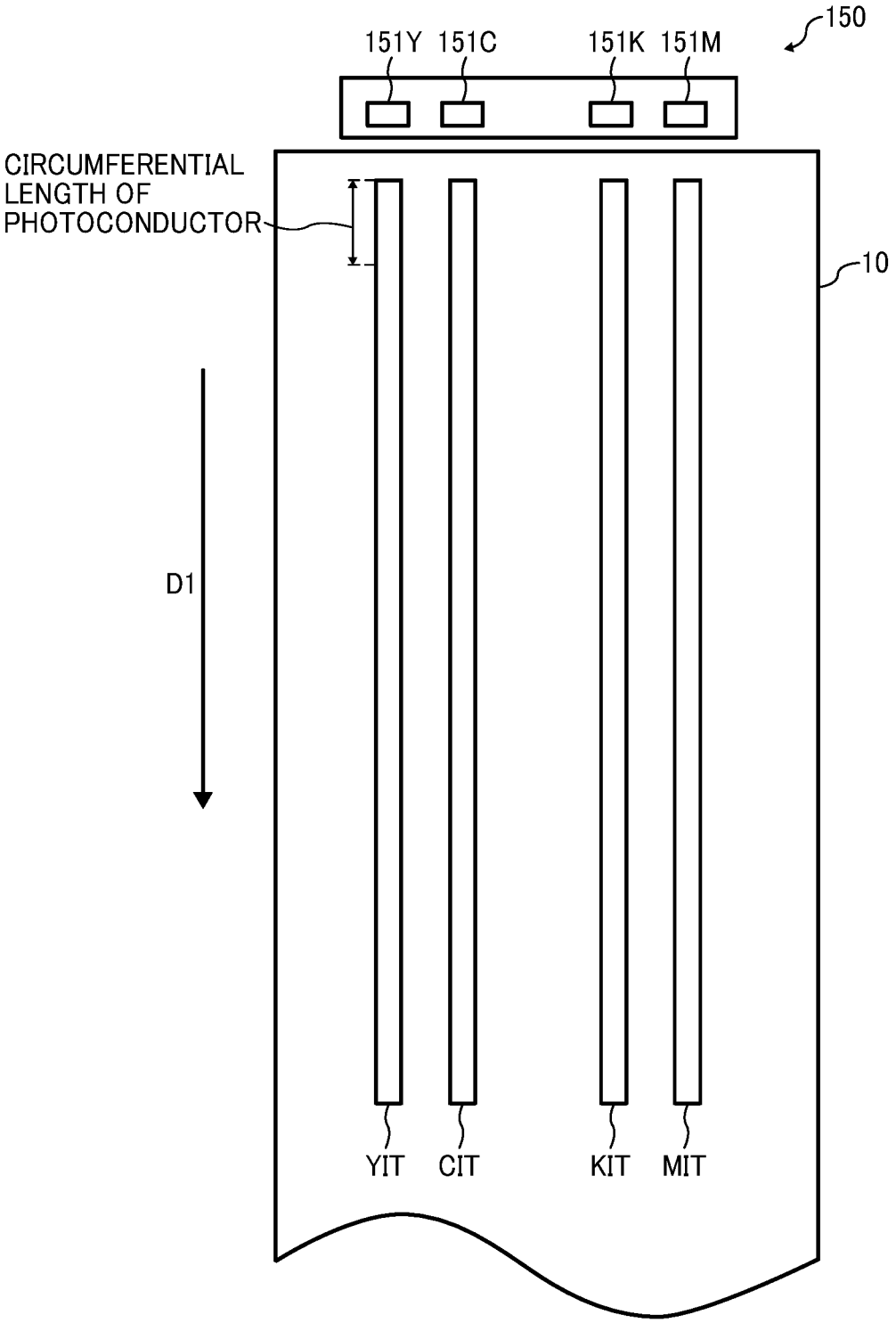
FIG. 12 is a schematic plan view of a first test toner image of each color on the intermediate transfer belt, according to embodiments of the present disclosure.

In the first detection process at the initial startup timing, initially, a first test toner image for yellow, which is a solid toner image, is formed on the photoconductor 20Y. In addition, a first test toner image for cyan, a first test toner image for magenta, and a first test toner image for black, which are respectively cyan, magenta, and black solid toner images, are formed on the photoconductor 20C, the photoconductor 20M, and the photoconductor 20K. Then, first test images YIT, CIT, MIT, and KIT are primarily transferred onto the intermediate transfer belt 10, as illustrated in FIG. 12. In FIG. 12, since the first test toner image YIT is used to detect the yellow image density fluctuation in the rotation cycle of the photoconductor 20Y, the first test toner image YIT is longer than the length of circumference (in the direction of arc) of the photoconductor 20Y in the belt travel direction indicated by arrow D1 in FIG. 12 that is a sub-scanning direction. Likewise, the first test images CIT, MIT, and KIT for cyan, magenta, and black are longer than the lengths of circumference of the photoconductors 20C, 20M, and 20K, respectively.

In FIG. 12, for convenience, four toner images, that is, the first test images YIT, CIT, MIT, and KIT are aligned in the belt width direction to detect the density unevenness. In practice, however, there are cases where the positions of the first test images of different colors on the belt may be shifted from each other, at most, by an amount equivalent to the length of circumference of the photoconductor 20. This is because, for each color, formation of the first test toner image is started to match a leading end position of the first test toner image with a reference position on the photoconductor 20 (photoconductor surface position entering the developing range at the reference attitude timing) in the direction of circumference of the photoconductor 20. That is, the first test toner image for each color is formed such that the leading end thereof matches the reference position of the photoconductor 20 in the direction of circumference. The length of the first test toner image of each color in the belt moving direction may be different.

Alternatively, instead of the solid toner image, a halftone toner image may be formed as the first test image. For example, the halftone toner image may be formed with dot coverage of 70%.

The controller 110 executes the first detection process and the process control together as a set. Specifically, immediately before the first detection process, the controller 110 executes the process control to determine the developing bias reference value for each color. In the first detection process executed immediately after the process control, the controller 110 controls the developing device 80Y, 80M, 80C, and 80K to develop, for each color, the first test toner image with the developing bias reference value determined by the process control. Accordingly, logically, the first test toner image is developed to have the target toner adhesion amount. However, actually, minute density unevenness occurs due to the gap fluctuation.

The time lag between the start of formation of the first test toner image (writing of the electrostatic latent image) and the arrival of the leading end of the first test toner image at a detection position by the reflective photosensor of the optical sensor unit 150 is different among the four colors. However, in the case of the same color, the time lag between writing and detection is constant over time, which is hereinafter referred to as "writing-detection time lag."

The controller 110 preliminarily stores the writing-detection time lag, for each color, in the nonvolatile memory. For each color, sampling of output from the reflective photosensor starts after the writing-detection time lag has passed from the start of formation of the first test image. This sampling is repeated at predetermined intervals throughout one rotation cycle of the photoconductor 20. The interval is identical to the interval of reading of each data in the first pattern data used in the first fluctuation control. The controller 110 generates, for each color, a density unevenness graph indicating the relation between the toner adhesion amount (image density) and time (photoconductor surface position), based on the sampling data. From the density unevenness graph, the controller 110 extracts two fluctuation patterns of solid image density: (1) the fluctuation pattern of solid image density occurring in photoconductor rotation cycle, and (2) the fluctuation pattern of solid image density occurring in sleeve rotation cycle.

After extracting the fluctuation pattern of solid image density in photoconductor rotation cycle and sleeve rotation cycle based on the sampled data for each color, the controller 110 executes the first pattern data generation process. In the first pattern data generation process, the controller 110 calculates an average toner adhesion amount (or an average image density) of the first test image. The average toner adhesion amount substantially reflects an average of the variation of the development gap in one rotary cycle of the photoconductor. Therefore, with respect to the average toner adhesion amount, the controller 110 generates the first pattern data for photoconductor cycle to offset the fluctuation pattern of solid image density in photoconductor rotation cycle. Specifically, the controller 110 calculates the bias output differences individually corresponding to a plurality of data values of toner adhesion amount included in the solid image density pattern. The bias output differences are based on the average toner adhesion amount. The bias output difference corresponding to the toner adhesion amount data identical in value to the average toner adhesion amount is calculated as zero.

The bias output difference corresponding to the toner adhesion amount data larger in value than the average toner adhesion amount is calculated as a positive value corresponding to the difference between that toner adhesion amount and the average toner adhesion amount. Being a plus value, this bias output difference changes the developing bias, which is negative in polarity, to a value lower (smaller in absolute value) than the developing bias reference value.

In addition, the bias output difference corresponding to the toner adhesion amount data smaller in value than the average toner adhesion amount is calculated as a negative value corresponding to the difference between that toner adhesion amount and the average toner adhesion amount. Being a minus value, this bias output difference changes the developing bias, which is negative in polarity, to a value higher (larger in absolute value) than the developing bias reference value. Thus, the controller obtains the bias output difference corresponding to each toner adhesion amount data and generates the first pattern data for photoconductor cycle, in which the obtained bias output differences are arranged in order.

In addition, after extracting, for each color, the fluctuation pattern of solid image density in sleeve rotation cycle based on the sampling data, the controller 110 calculates an average toner adhesion amount (average image density). The average toner adhesion amount substantially reflects an average of the variation of the development gap in one rotary cycle of the developing sleeve. Therefore, with respect to the average toner adhesion amount, the controller 110 generates the first pattern data for sleeve cycle to offset the fluctuation pattern of solid image density in sleeve rotation cycle. The first pattern data for sleeve cycle can be generated through process similar to the process to generate the first pattern data for photoconductor cycle to offset the solid image density fluctuation in photoconductor rotation cycle.

Figure 13:
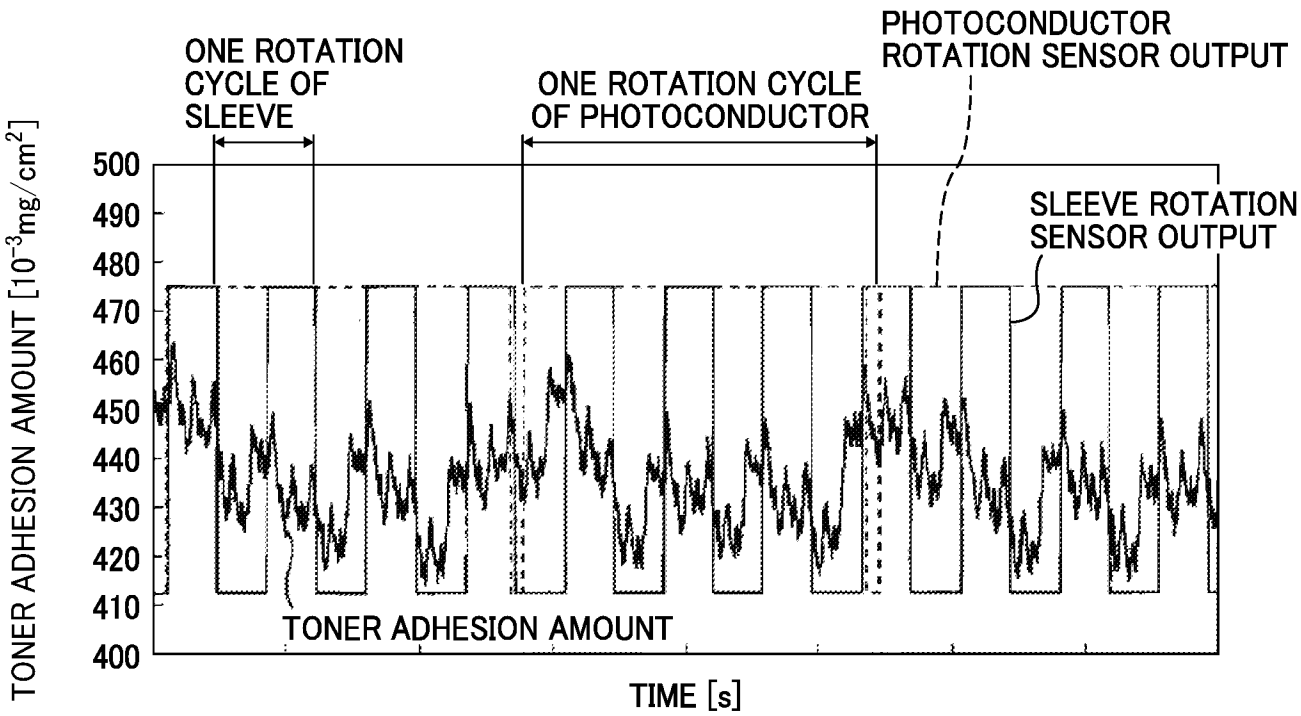
FIG. 13 is a graph illustrating a relation between cyclic fluctuations in the toner adhesion amount of the first test image, output from a sleeve rotation sensor, and output from the photoconductor rotary sensor.

FIG. 13 is a graph illustrating a relation between cyclic fluctuations in the toner adhesion amount of the first test image, output from a sleeve rotation sensor, and output from the photoconductor rotary sensor. The vertical axis of the graph represents the toner adhesion amount in $10^{-3}$ mg/cm$^2$, which is obtained by converting the output voltage from the reflective photosensor 151 of the optical sensor unit 150 according to a predetermined conversion formula. It is understood that the image density of the first test toner image exhibits cyclical fluctuation pattern in the travel direction of the intermediate transfer belt 10.

Figure 14:
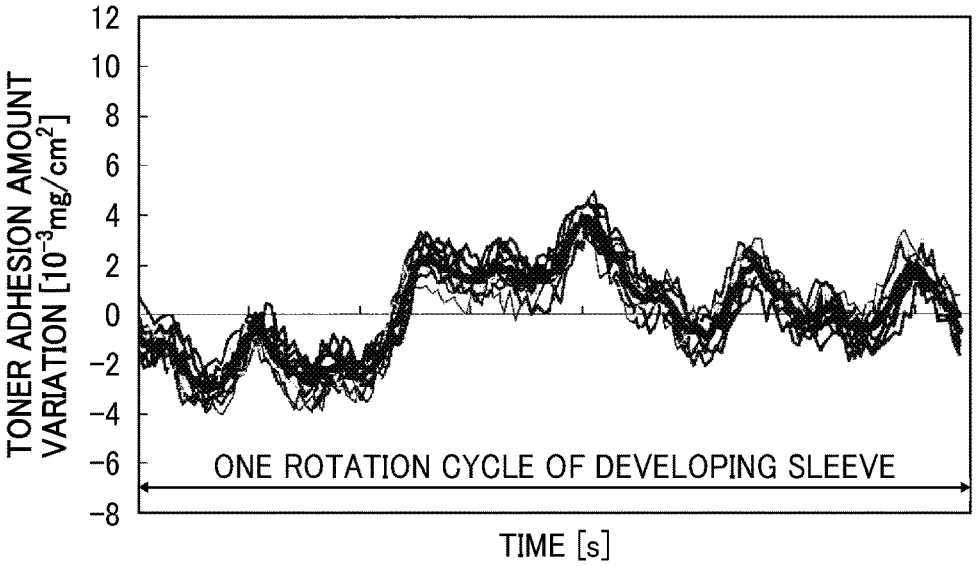
FIG. 14 is a graph illustrating an average waveform.

In generating the first pattern data (developing variation pattern) for sleeve cycle, initially, in order to remove the cyclic fluctuation components different from those of sleeve cycle, the controller 110 takes out data on fluctuation with time of toner adhesion amount per sleeve rotation cycle and performs averaging. Specifically, the length of the first test toner image is at least ten times longer than the length of circumference of the developing sleeve 81. Accordingly, the data on fluctuation with time of toner adhesion amount is obtained for a period equivalent to ten times or more of sleeve rotation cycle. Based on this data, a fluctuation waveform starting from the sleeve reference attitude timing is cut out for each sleeve rotation cycle. Thus, ten fluctuation waveforms are cut out. Subsequently, as illustrated in FIG. 14, the cutout waveforms are superimposed, with the sleeve reference attitude timings thereof synchronized with each other, and averaged. Then, the average waveform is analyzed.

The average waveform obtained by averaging the ten cutout waveforms is indicated by a thick line in FIG. 14. The individual cutout waveforms include cyclic fluctuation components deviating from those in the sleeve rotation cycle and are not smooth. By contrast, in the average waveform, deviation is reduced. In the copier according to the present embodiment, averaging is performed as to ten cutout waveforms; however, another method may be used as long as the sleeve rotary cycle variation components can be extracted.

Figure 15:
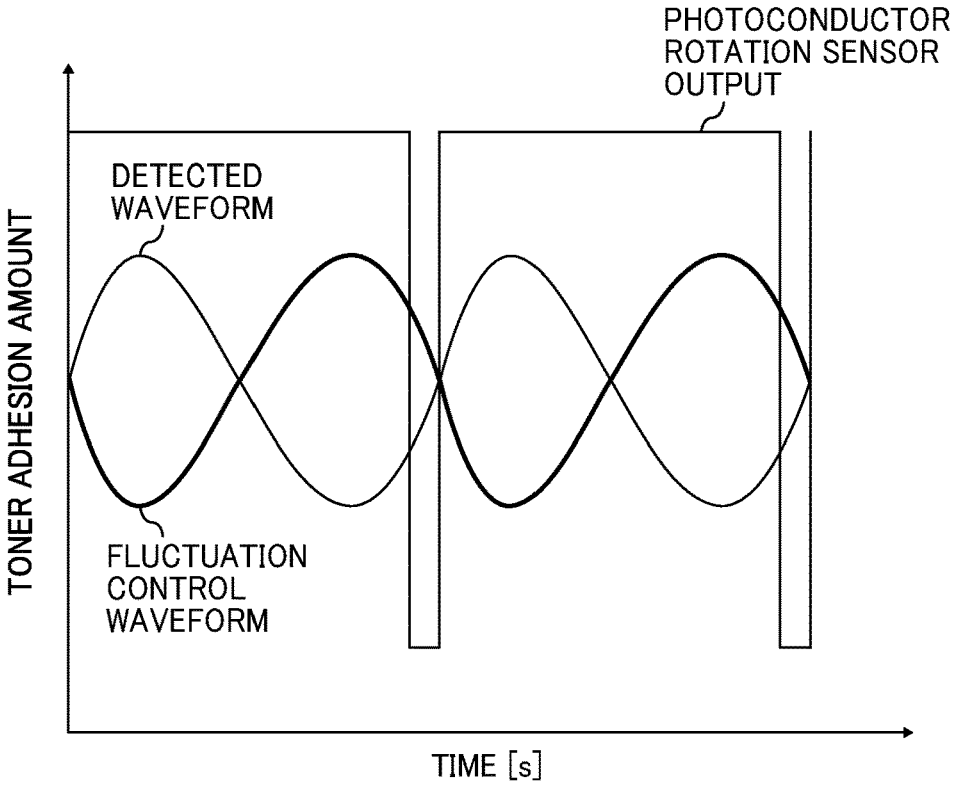
FIG. 15 is a graph illustrating an algorithm used in generating a developing-bias change pattern, according to embodiments of the present disclosure.

Similar to the first pattern data for sleeve cycle, the controller 110 generates the one for photoconductor cycle based on the result of averaging of the waveforms cutout per photoconductor rotation cycle. To generate the first pattern data based on the average waveform, the toner adhesion amounts are converted into developing bias variations using, for example, an algorithm that changes the developing bias to draw a fluctuation control waveform, as illustrated in FIG. 15, reverse in phase to the detected waveform, in FIG. 14, of the toner adhesion amount. The detected waveform in FIG. 15 is schematically drawn.

Figure 16:
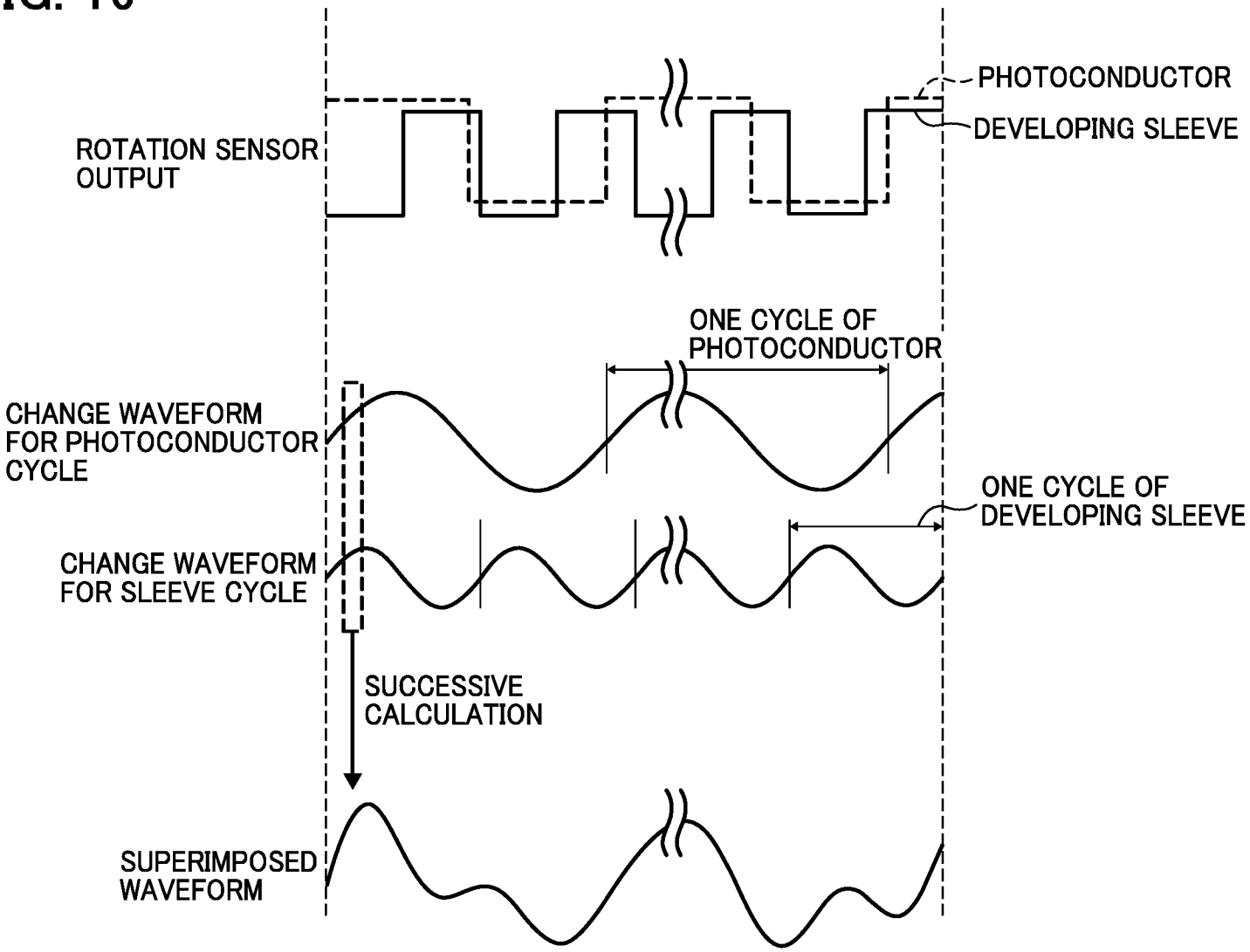
FIG. 16 is a timing chart illustrating output timing in image formation, according to embodiments of the present disclosure.

As described above, for each color, the output of developing bias Vb from the developing power supply 11Y, 11C, 11M, and 11K is varied, using the first pattern data for photoconductor cycle and the first pattern data for sleeve cycle generated in the first pattern process which are fluctuation pattern data of the fluctuating developing voltage. More specifically, as illustrated in FIG. 16, the developing bias is cyclically changed in accordance with the superimposed waveform in which the waveform of variation based on the first pattern data for photoconductor rotation cycle and the waveform of variation based on the first pattern data for sleeve cycle are superimposed. As a result, the image density fluctuation occurring in the photoconductor rotation cycle or that occurring in the sleeve rotation cycle can be suppressed.

Figure 17:
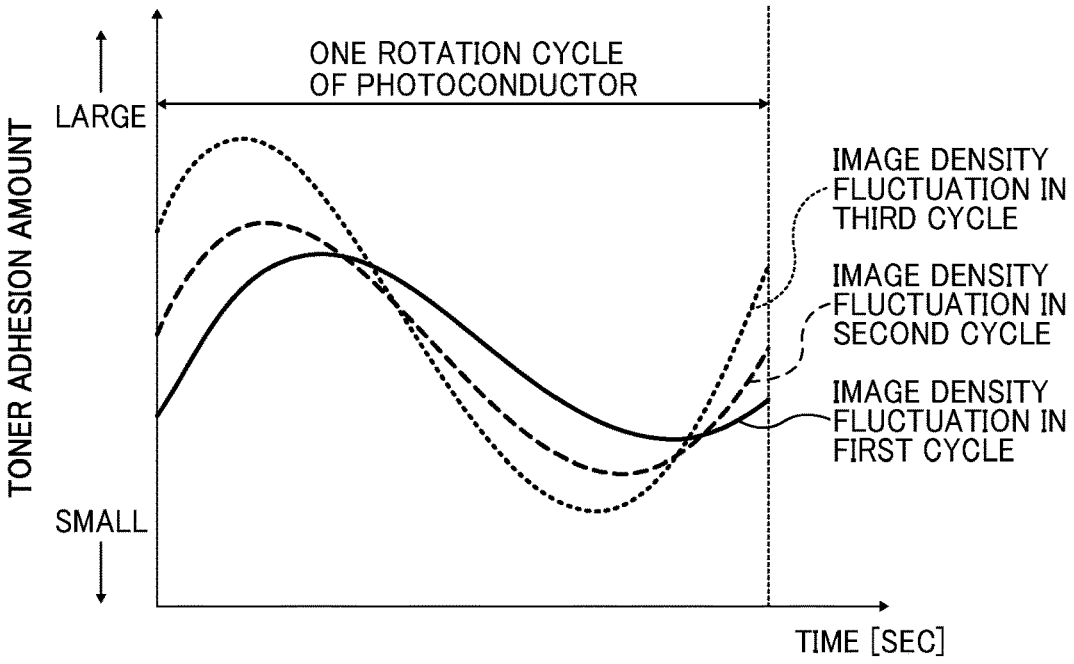
FIG. 17 is a graph illustrating a measurement error of toner adhesion amount.

The image density fluctuation in the photoconductor rotation cycle includes measurement errors due to various factors as illustrated in FIG. 17. In FIG. 17, the phases and the amplitudes in the image density fluctuations of periods do not match. The image density fluctuation in the sleeve rotation cycle also includes similar measurement errors. When the first pattern data for the photoconductor rotation cycle and the first pattern data for the sleeve rotation cycle are generated from the image density fluctuation including large measurement errors described above, the first fluctuation control based on the first pattern data may increase the image density fluctuation. Therefore, after execution of the first detection process, and before execution of the first pattern data generation process, the controller 110 executes a determination process to determine whether the first fluctuation control should be executed.

At the beginning of the determination process, the controller 110 calculates amplitude A1, A2, and A3 with phase θ1, θ2, and θ3, respectively, for each of the waveforms cutout per photoconductor rotation cycle (wave form data of the image density fluctuation data). The calculations may be performed by using an orthogonal wave form detection processing or fast Fourier transform (FFT) processing.

The controller 110 stores the calculated data including amplitudes A1, A2, A3, . . . and phases θ1, θ2, θ3, . . . corresponding to a plurality of cycles. The controller 110 calculates a variation σ1 in the amplitudes A1, A2, A3, . . . of the plurality of cycles and a variation σ2 in the phases θ1, θ2, θ3, . . . of the plurality of cycles. In the example as illustrated in FIG. 17, when the image density fluctuation for one rotation cycle of the photoconductor is set as one measurement unit, the controller 110 calculates variations σ1 and σ2 from the image density fluctuation data (i.e., the amplitude and the phase data) measured three times. However, the controller 110 may set the image density fluctuation of a plurality of rotation cycles of the photoconductor as one measurement unit and calculate variations σ1 and σ2 in the image density fluctuation data (i.e., the amplitude and the phase data) of a plurality of rotation cycles of the photoconductor measured a plurality of times. For example, from the toner adhesion amount readings of the first to third photoconductor cycles, a first set of amplitude data A1 and phase data θ1 is calculated by using the direct wave detection processing. Similarly, from the toner adhesion amount reading of the fourth to sixth rotation cycles of the photoconductor, a second set of amplitude data A2 and phase data θ2 is calculated, and the above calculation operation is repeated so that multiple image density fluctuation data (A1, A2, A3, . . . , θ1, θ2, θ3, . . . ) may be obtained. In this case, the image density fluctuation data with higher precision may be obtained. However, because the length of the toner pattern in the sub-scanning direction needs to be extended, there is disadvantage due to the longer processing time and increased toner consumption amount.

As the image density fluctuation data, the controller 110 may use output signals of the reflective photosensor or the data converted into the toner adhesion amounts from the output signals of the reflective photosensor.

The variation σ1 among the amplitude data A1, A2, A3, . . . , of multiple cycles may be defined as follows. For example, difference between each amplitude data (|A1-A2|, |A1-A3|, |A2-A3|, . . . ) is calculated, and the maximum value may be defined as the variation σ1. Otherwise, for example, deviation from an average value of the amplitude data, or dispersion or standard deviation may be used as the variation σ1. As to the variation σ2 among the phase data θ1, θ2, θ3, . . . , of multiple cycles, the same definition may be used.

The controller 110 compares the thus-obtained variations σ1 and σ2 with the preset thresholds in the determination process. If both the variation σ1 of the amplitude and the variation σ2 of the phase are less than or equal to each corresponding threshold, the controller 110 calculates variations σ1 and σ2 for the waveforms cutout per the sleeve rotation cycle similarly. If both the variation σ1 of the amplitude and the variation σ2 of the phase for the sleeve rotation cycle are less than or equal to each corresponding threshold, the controller 110 determines to execute the first fluctuation control.

On the other hand, if any one of the variations σ1 and σ2 in the image density fluctuation of the photoconductor rotation cycle and the variation σ1 and σ2 in the image density fluctuation of the sleeve rotation cycle exceeds the corresponding threshold, the controller 110 determines not to execute the first fluctuation control.

Above described control avoids deterioration of a cyclical image density fluctuation caused by the execution of the first fluctuation control using unsuitable first pattern data. Alternatively, the controller 110 may determine executing the first fluctuation control if all of the variations σ1 and σ2 in the image density fluctuation of the photoconductor rotation cycle and the sleeve rotation cycle are less than each corresponding threshold, and not executing the first fluctuation control if any one of these variations σ1 and σ2 are equal to or more than the corresponding threshold.

Instead of the determination of the execution of the first fluctuation control based on the variation of the image density fluctuation for rotation cycles, the controller 110 may execute the following determination process. The controller 110 may execute the first pattern data generation process based on the data from the first test toner image and may generate the first pattern data. Subsequently, the controller may form the first test toner image again based on the first pattern data and determine whether the first pattern data generation process should be executed based on a variation of an image density fluctuation derived from detection of the first test toner image formed again. Hereinafter the case when the variations σ1 and σ2 for the photoconductor rotation cycles and for the sleeve rotation cycles are less than the corresponding threshold, or equal to or less than the corresponding threshold is called a small variation case. The opposite case is called a large variation case.

The copier 500 according to the embodiment executes a second fluctuation control and a third fluctuation control in addition to the first fluctuation control when they are needed in the image forming process.

In the second fluctuation control, the controller 110 generates a second pattern data for the photoconductor cycle and that for the sleeve cycle and cyclically changes a charging bias based on the second pattern data. That is, the charging bias changes according to a voltage fluctuation pattern determined based on the second pattern data described above that is fluctuation pattern data of a fluctuating charging voltage. In the third fluctuation control, the controller 110 generates a third pattern data for the photoconductor cycle and that for the sleeve cycle and cyclically changes the LD power of the laser writing device 21 (writing intensity) based on the third data. That is, the LD power changes according to a writing intensity fluctuation pattern determined based on the third pattern data described above that is fluctuation pattern data of fluctuating writing intensity.

The controller 110 executes the second fluctuation control because, in an image including a solid portion and a halftone portion, the image density of the solid portion is greatly affected by the developing potential being the difference between the developing bias Vb and the latent image potential Vl that is the potential of the electrostatic latent image. By contrast, the image density of the halftone portion may be greatly affected by the background potential that is the difference between the charged potential Vd of the photoconductor and the developing bias Vb, compared with the developing potential.

Specifically, in the solid portion, each dot overlaps adjacent dots. That is, there is no isolated dot. By contrast, the halftone portion includes isolated dots or a small number dot group that is a set of a small number of dots. The isolated dot and the small number dot group are greatly affected by an edge effect than the solid portion. Accordingly, when the background potential is identical between the solid portion and the halftone portion, the force of adhesion to the photoconductor is stronger in the halftone portion than in the solid portion, and the halftone portion is less affected by the gap fluctuation.

Further, the toner adhesion amount per unit area in the halftone portion is greater than the one in the solid portion. Accordingly, a fluctuation of the toner adhesion amount in the halftone portion caused by the gap fluctuation is smaller than the one in the solid portion. When the developing bias Vb is changed using the superimposed output pattern generated based on the first test toner image that is the solid toner image, the image density fluctuation in the solid portion can be suppressed. However, in the halftone portion, an overcorrection results in the image density fluctuation in the halftone portion.

Since the edge effect is heavily affected by the background potential, the background potential may be adjusted to adjust the above-described overcorrection. The adjustment of the background potential is performed by changing the charging bias that results in a change of the charged potential Vd.

After the controller 110 generates the first pattern data for photoconductor cycle and that for sleeve cycle, which individually corresponds to each of yellow, cyan, magenta, and black, the controller 110 executes the second detection process.

In the second detection process, the controller 110 forms a yellow second test pattern that is a yellow half tone toner image on the photoconductor 20Y. In addition, a second test toner image for cyan, a second test toner image for magenta, and a second test toner image for black, which are respectively cyan, magenta, and black halftone toner images, are formed on the photoconductor 20C, the photoconductor 20M, and the photoconductor 20K, respectively. When the controller 110 forms the second test images, the controller 110 changes the developing bias Vb based on the developing bias reference value, the first pattern data for photoconductor cycle, the photoconductor reference attitude timing, the first pattern data for sleeve cycle, and the sleeve reference attitude timing.

Such conditions suppress the image density fluctuation in the solid portion corresponding to the photoconductor rotation cycle and the sleeve rotation cycle, but causes the image density fluctuation in the halftone portion that are the four second test images described above due to the overcorrection of the developing bias Vb. To detect the image density fluctuation, the controller 110 samples the outputs from the four reflective photosensors 151 of the optical sensor unit 150 at predetermined intervals for a period equal to or longer than one rotation cycle of the photoconductor 20. Subsequently, the controller 110 extracts a pattern of the image density fluctuation occurring in the photoconductor rotation cycle, based on the sampled data obtained for each color.

An area coverage modulation ratio of the above-described second test toner image is set to 50% with respect to 100% of the solid image. That is, the proportion of area where dots are attached by toner among the entire area of the second test toner image is set to 50%. This ratio may be changed. This ratio is preferably set in the range of 10% to 50% and may be set in the range of 10% to 90%. Setting this ratio 100%, which is extremely dark, and setting this ratio of extremely thin image is avoided.

Next, the controller 110 extracts a pattern of the image density fluctuation in the sleeve rotation cycle based on the above described sampled data for each color.

After the second detection process, the controller 110 executes the second pattern process if needed. In the second pattern process, the controller 110 calculates an average toner adhesion amount (or an average image density) of the second test toner image based on the pattern of the image density fluctuation occurring in the photoconductor rotation cycle. Thereafter, the controller 110 generates the second pattern data that changes the charging bias with reference to the average toner adhesion amount in the photoconductor rotation cycle to offset the pattern of the image density fluctuation of the halftone portion occurring in the photoconductor rotation cycle.

Specifically, the controller 110 calculates the bias output differences individually corresponding to a plurality of toner adhesion amounts that are included in the pattern of the image density fluctuation occurring in the photoconductor rotation cycle. The bias output differences are based on the average toner adhesion amount. The bias output difference corresponding to the toner adhesion amount data identical in value to the average toner adhesion amount is calculated as zero. The bias output difference corresponding to the toner adhesion amount more than the average toner adhesion amount is calculated as a negative value corresponding to the difference between that toner adhesion amount and the average toner adhesion amount. Being a minus value, this bias output difference changes the charging bias, which is negative in polarity, to a value higher (larger in absolute value) than the charging bias reference value.

In addition, the bias output difference corresponding to the toner adhesion amount less than the average toner adhesion amount is calculated as a plus value corresponding to the difference between that toner adhesion amount and the average toner adhesion amount. Being a plus value, this bias output difference changes the charging bias, which is negative in polarity, to a value lower (smaller in absolute value) than the charging bias reference value. Thus, the controller 110 obtains the bias output differences individually corresponding to the plurality of toner adhesion amounts and generates the second pattern data for photoconductor cycle, in which the obtained bias output differences are arranged in order.

Next, the controller 110 generates the second pattern data for sleeve rotation cycle to offset the pattern of image density fluctuation in the sleeve rotation cycle. The controller 110 generates the second pattern data through process similar to the process similar to the process to generate the second pattern data for the photoconductor cycle.

After that, ordinal numbers of individual data values in the second pattern data for the photoconductor cycle are shifted by a predetermined number. Specifically, the leading data in the second pattern data for photoconductor cycle corresponds to, of an entire surface of the photoconductor 20, a photoconductor surface position entering the developing range when the photoconductor 20 takes the reference rotation attitude. The position is charged in not the developing range but the area of contact between the charging roller 71 and the photoconductor 20. Since it takes time (i.e., time lag) for the photoconductor surface to move from the charging contact position to the developing range, the position of each data is shifted by a number corresponding to the time lag.

For example, when the pattern data includes 250 data values, positions of the first to 230th data values are shifted by 20, and the 231st data value to the 250th data value are changed to the first to 20th data. Regarding the second pattern data for sleeve cycle that is the charging-bias output pattern for sleeve cycle, the positions of the data values are similarly shifted by a predetermined number.

When an image is formed in response to a command from a user, outputs of the developing bias Vb from the developing power supplies are changed based on the first pattern data for the photoconductor cycle and the first pattern data for the sleeve cycle formulated in the first pattern process, for each color. Specifically, the controller 110 generates the superimposed output pattern data (data to reproduce the superimposed waveform) based on the first pattern data for photoconductor cycle, the photoconductor reference attitude timing, the first pattern data for sleeve cycle, and the sleeve reference attitude timing. Subsequently, the controller 110 changes the output value of the developing bias Vb based on the superimposed output pattern and the developing bias reference value. This process reduces the image density fluctuation of the solid portion occurring in the photoconductor rotation cycle and the sleeve rotation cycle.

In parallel to changing the developing bias as described above, the controller 110 changes the output of the charging bias from the charging power supply 12 based on the second pattern data for photoconductor cycle and that for sleeve cycle that are generated in the second pattern data generation process. Specifically, the controller 110 generates the superimposed output pattern data based on the second pattern data for photoconductor cycle, the photoconductor reference attitude timing, the second pattern data for sleeve cycle, and the sleeve reference attitude timing. Subsequently, the controller 110 changes the output value of the charging bias from the charging power supply 12 based on the superimposed output pattern data and the charging bias reference value that has been determined in the process control. This process reduces the image density fluctuation of the halftone portion in the photoconductor rotation cycle and the sleeve rotation cycle due to the overcorrection of the developing bias Vb.

However, even by cyclically changing the developing bias and the charging bias, the cyclical image density fluctuation still remains. Such cyclic image density fluctuation is hereinafter called as a "residual cyclic fluctuation". Cyclically changing the charging bias based on the second pattern data causes the residual cyclic fluctuation.

Figure 18:
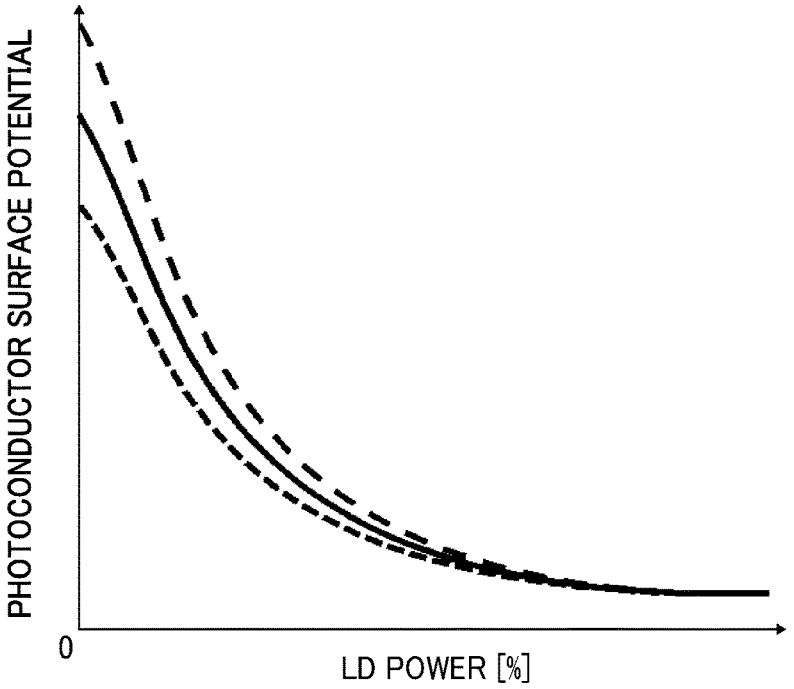
FIG. 18 is a graph illustrating relations between the laser diode (LD) power (%) in the optical writing and the electrostatic latent image potential attained by optical writing on the background portion when the charger uniformly charges the background portion to three charged potentials.

FIG. 18 is a graph illustrating relations between the LD power (%) in the optical writing and the electrostatic latent image potential attained by optical writing on the background portion when the charger uniformly charges the background portion to three charged potentials. In FIG. 18, the charged potential is the surface potential of the photoconductor 20 corresponding to an LD power of 0%, and the latent image potential is the surface potential of the photoconductor 20 corresponding to an LD power greater than 0%. The optical writing on the background portion causes attenuation of the surface potential of the photoconductor to a degree that corresponds to the LD power. A region of the photoconductor where the surface potential attenuates becomes the latent image.

As illustrated in FIG. 18, light attenuation characteristics change depending on the charged potential of the photoconductor (values corresponding to LD power=0%). Therefore, when the charging bias is cyclically changed based on the second pattern data, the charged potential of the photoconductor is cyclically changed accordingly, and this cyclical fluctuation changes a potential of the latent image on the photoconductor cyclically. A cyclic image density fluctuation caused by the cyclic fluctuation of the potential of the latent image is the residual cyclic fluctuation caused by the cyclically changed charging bias.

To restrict the width of residual cyclic fluctuation to a predetermined amount, in the formula for obtaining LD power LDi' to be described later, for the amount by which the charging bias Vci exceeds a threshold voltage Vmax, the copier 500 according to the present embodiment adds the LD power Ldi to a value corresponding to the difference between the threshold voltage Vmax and the charging bias Vci, which will be described in detail later.

Before execution of the third pattern data generation process that generates third pattern data to change the LD power cyclically, the controller 110 executes a third detection process. In the third detection process, firstly, while cyclically changing the developing bias Vb based on the first pattern data generated in advance, the controller 110 cyclically changes the charging bias Vc based on the second pattern data generated in advance, to thereby form a third test toner image that is a solid toner image. The reflective photosensor 151 detects an image density fluctuation (a residual cyclic fluctuation) of the third test image. The controller 110 executes a frequency analysis for the detected residual cyclic fluctuation and extracts a residual cyclic fluctuation in the photoconductor rotation cycle and a residual cyclic fluctuation in the sleeve rotation cycle.

An area coverage modulation ratio of the third test toner image is set to 70% with respect to 100% of the solid image. That is, the proportion of area where dots are attached by toner among the entire area of the third test toner image is set to 70%.

After detecting the residual cyclic fluctuation in the third detection process, the controller 110 executes the third pattern data generation process when the third pattern data generation process is needed. In the third pattern data generation process, the controller 110 generates the third pattern data for photoconductor cycle and that for sleeve cycle. Specifically, the controller 110 generates, as the third pattern data, a formula: $\Sigma Ldi' \times \sin(i \times \omega t + \theta i)$ in which an amplitude Ldi' of the LD power calculated based on the amplitude Ai of sine wave regarding the residual cyclic fluctuation is substituted. This formula is hereinafter referred to as a "third pattern formula."

In the third pattern data generation process, the controller 110 assigns each data of the residual cyclic fluctuation in the photoconductor rotation cycle and the residual cyclic fluctuation in the sleeve rotation cycle to a predetermined conversion algorithm and generates a tentative third pattern data for photoconductor cycle and that for sleeve cycle. The conversion algorithm converts each of a plurality of image density values included in the residual cyclic fluctuation into a LD power value that gives a desired image density based on experiments that use a predetermined charging bias and a predetermined LD power. Based on the conversion algorithm, the controller 110 converts each of a plurality of image density values included in the residual cyclic fluctuation into a LD power value and generates the third pattern data including a plurality of LD power values. The third pattern data that is data of the writing intensity fluctuation pattern is the formula: $\Sigma Ldi \times \sin(i \times \omega t + \theta i)$ in which an amplitude Ldi of the LD power calculated based on the amplitude Ai of the residual cyclic fluctuation regarding the halftone image density unevenness is substituted.

In the third fluctuation control, the controller 110 calculates each of LD powers Ldi (i=1 to x) based on the third pattern data (the third pattern formula). The controller 110 normalizes the results of such calculation with the predetermined reference value to generate a group of data. Subsequently, the controller 110 cyclically changes the LD power based on the group of data. Such cyclic change of the LD power makes it possible to reduce the residual cyclic fluctuation.

As described above, the copier 500 according to the present embodiment has a following configuration. That is, the copier 500 includes the charging rollers 71Y, 71C, 71M, and 71K to charge the surfaces of the photoconductors 20Y, 20C, 20M, and 20K, the laser writing device 21 to write the electrostatic latent images on the charged surfaces of the photoconductors 20Y, 20C, 20M, and 20K, and the developing sleeves 81Y, 81C, 81M, and 81K to develop the electrostatic latent image with the developer. Additionally, the copier 500 uses the charging bias that is applied to the charging rollers 71Y, 71C, 71M, and 71K whose voltage is obtained by superimposing the fluctuating charging voltage that is changed to reduce the cyclic image density fluctuation on the charging bias reference value that is the direct current voltage. In addition, the copier 500 uses the developing bias that is applied to the developing sleeve 81Y, 81C, 81M, and 81K whose voltage is obtained by superimposing the fluctuating developing voltage that is changed to reduce the cyclic image density fluctuation on the developing bias reference value that is the direct current voltage and the laser writing intensity at which the laser writing device 21 writes the electrostatic latent image whose power is obtained by superimposing the fluctuating writing intensity that is changed to reduce the cyclic image density fluctuation on a constant LD power that is the reference LD power.

When the controller 110 executes the above described calculation to reduce the image density fluctuation, there is a case in which the variations $\sigma$1 and $\sigma$2 in the image density fluctuation that are detected in the first detection process are large, and the variations $\sigma$1 and $\sigma$2 in the image density fluctuation that are detected in the second detection process are small. In the above described case, present inventors found that the cyclic image density fluctuation in the halftone portion when the controller determines not to execute the first fluctuation control in parallel to the image forming process and executing the second fluctuation control in parallel to the image forming process becomes worse than the cyclic image density fluctuation in the halftone portion when the controller determines not to execute both the first and second fluctuation control.

Specifically, the second fluctuation control is executed to reduce the cyclical image density fluctuation of the halftone portion due to the variation of the background potential caused by the cyclical change of the developing bias in the first fluctuation control. In the case that the first fluctuation control is not executed, that is, in the case that the developing bias is not changed cyclically, the cyclical variation of the background potential caused by the cyclical change of the developing bias does not occur. Therefore, without changing the charging bias cyclically, keeping the charging bias constantly makes it possible to keep the background potential within a constant range. An execution of only the second fluctuation control causes the cyclical variation of the background potential due to the cyclical change of the charging bias. The cyclical variation of the background potential causes the cyclical image density fluctuation of the halftone portion. Thus, the cyclical image density fluctuation of the halftone portion deteriorates.

There is also a case in which the variations σ1 and σ2 in the image density fluctuation that are detected in the first detection process are small, and the variations σ1 and σ2 in the image density fluctuation that are detected in the second detection process are large. In the above described case, when the controller 110 determines to execute the first fluctuation control in parallel to the image forming process and skip the second fluctuation control in the determination process, the cyclical image density fluctuation of the halftone portion occurs because execution of only the first fluctuation control results in the cyclical variation of the background potential. That is, the cyclical image density fluctuation of the halftone portion occurs in an image including the solid portion and the halftone portion and an image including only the halftone portion and not including the solid portion (hereinafter such images are called as a halftone reproduction image). Because the cyclical image density fluctuation of the halftone portion is more noticeable than the cyclical image density fluctuation of the solid portion, the execution of only the first fluctuation control out of the first and second fluctuation controls makes the image quality worse, as compared with the case where the controller 110 determines not to execute both the first and the second fluctuation control.

Therefore, the controller 110 handles the first and second fluctuation control as a set in the determination process and always determines whether the controller 110 executes the set of the two controls. Above described control avoids deterioration of the cyclical image density fluctuation of the halftone portion caused by the execution of only the second fluctuation control and a bad image quality of the halftone reproduction image caused by the execution of only the first fluctuation control.

Figure 19:
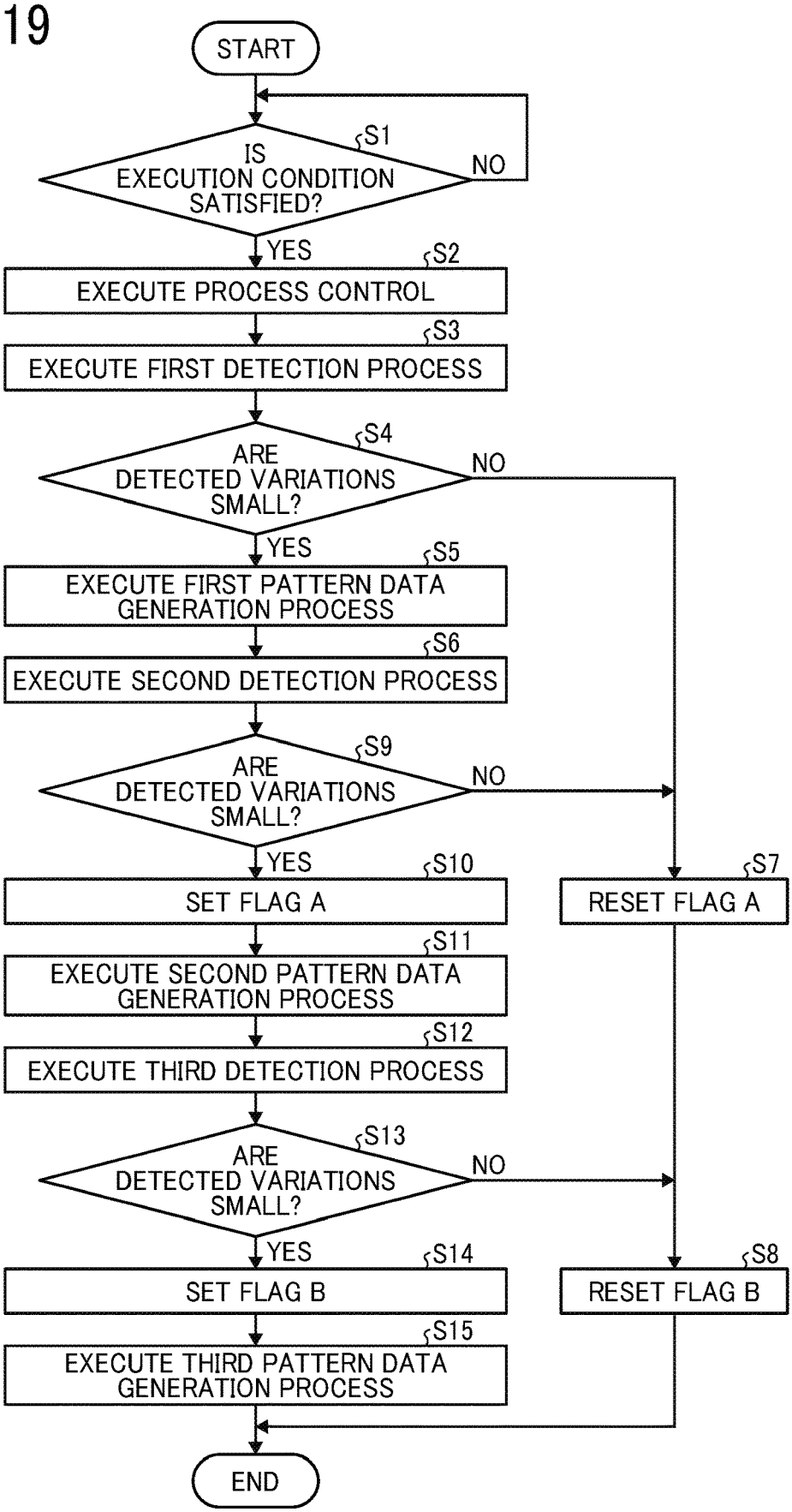
FIG. 19 is a flowchart illustrating steps in a process of a regular adjustment control performed by a controller of the image forming apparatus.

FIG. 19 is a flowchart illustrating steps in a process of a regular adjustment control performed by the controller 110. When an execution condition is satisfied in the regular adjustment control (Yes in step S1), the controller 110 executes the process control (step S2). After the process control, the controller 110 executes the first detection process (step S3). As described above, this first detection process is an image density fluctuation detection process to generate the first pattern data that is the fluctuation pattern data of the fluctuating developing voltage. In step S4, the controller 110 determines whether either the variations σ1 or the variations σ2 in the image density fluctuation detected in the first detection process is smaller than the corresponding threshold. When either of the variations σ1 or σ2 is equal to or greater than the corresponding threshold (No in step S4), the first fluctuation control based on the first pattern data generated from the image density fluctuation with the great variation may increase the cyclical image density fluctuation of the solid portion. Therefore, in such a case, the controller 110 terminates the sequential process flow after resets of a flag A and a flag B (step S7 and step S8).

The flag A is a parameter to illustrate whether the first fluctuation control and the second fluctuation control should be executed in parallel with the image forming process executed after the regular adjustment control. Setting of the flag A means the controller 110 determines the execution of the two fluctuation controls. In contrast, resetting of the flag A means the controller 110 determines not to execute the first and second fluctuation controls.

The flag B is a parameter to illustrate whether the third fluctuation control that cyclically changes LD power should be executed in parallel with the image forming process executed after the regular adjustment control. Setting of the flag B means the controller 110 determines the execution of the third fluctuation control. In contrast, resetting of the flag B means the controller 110 determines not to execute the third fluctuation control.

When either of the variations σ1 and σ2 in the image density fluctuation detected in the first detection process that is the image density fluctuation detection process to generate the first pattern data (that is the fluctuation pattern data of the fluctuating developing voltage) is equal to or greater than the corresponding threshold (No in step S4), the controller resets the flag A in step S7 and does not execute the first fluctuation control that cyclically changes the developing bias and the second fluctuation control that cyclically changes the charging bias. This arrangement has the following advantage. That is, this control avoids the occurrence of the cyclical image density fluctuation of the halftone portion caused by the execution of only the second fluctuation control out of the first and second fluctuation control.

When the flag A is reset in step S7, the residual cyclic fluctuation (described above) does not occur in the subsequent image forming process. So, the third fluctuation control that cyclically changes the LD power is not needed to decrease the residual cyclic fluctuation. Therefore, in such a case, the controller 110 also resets flag B in step S8 and terminates the sequential process flow.

On the other hand, when the variations σ1 and σ2 in the image density fluctuation detected in the first detection process that is the image density fluctuation detection process to generate the first pattern data (that is the fluctuation pattern data of the fluctuating developing voltage) is less than the corresponding threshold (Yes in step S4), it is possible to generate a suitable first pattern data based on the image density fluctuation. The controller 110 executes the first pattern data generation process in step S5 to generate the first pattern data for photoconductor cycle and the one for sleeve cycle. Subsequently, the controller 110 executes the second detection process, which is the image density fluctuation detection process to generate the second pattern data (that is the fluctuation pattern data of the fluctuating charging voltage), in step S6 to obtain the image density fluctuation of the second test toner image and determines whether either the variations σ1 or the variations σ2 in the image density fluctuation detected in the second detection process is smaller than the corresponding threshold in step S9.

When either of the variations σ1 and σ2 in the image density fluctuation of the second test toner image is equal to or greater than the corresponding threshold (No in step S9), the second fluctuation control that cyclically changes the charging bias based on the second pattern data generated from the image density fluctuation with the great variation may increase the cyclical image density fluctuation of the halftone portion. Therefore, in such a case, the controller 110 resets the flag A and the flag B in step S7 and step S8 and terminates the sequential process flow. Above described control avoids deterioration of a cyclical image density fluctuation of the halftone portion caused by the execution of the second fluctuation control using unsuitable second pattern data. Additionally, not executing the first fluctuation control that cyclically changes the developing bias avoids a bad image quality of the halftone reproduction image caused by the execution of only the second fluctuation control out of the first and second fluctuation control.

On the other hand, when the variations σ1 and σ2 in the image density fluctuation of the second test toner image is less than the corresponding threshold (Yes in step S9), it is possible to generate a suitable second pattern data based on the image density fluctuation. The controller 110 sets flag A, determines the execution of the first fluctuation control that cyclically changes the developing bias and the second fluctuation control that cyclically changes the charging bias in step S10 and executes the second pattern process based on the image density fluctuation described above. Thus, the controller 110 generates the second pattern data for photoconductor cycle and the one for sleeve cycle as the fluctuation pattern data of the fluctuating charging voltage in step S11.

Next, the controller 110 that generates the second pattern data as described above executes the third detection process as the image density fluctuation detection process to generate the third pattern data that is the fluctuation pattern data of the fluctuating writing intensity in step S12. Subsequently, the controller 110 determines whether either the variations σ1 or the variations σ2 in the image density fluctuation of the third test toner image detected in the third detection process is smaller than the corresponding threshold in step S13. When either the variations σ1 or the variations σ2 is equal to or greater than the corresponding threshold (No in step S13), the third fluctuation control, which cyclically changes the LD power, based on the third pattern data generated from the image density fluctuation described above may increase the residual cyclic fluctuation. Therefore, in such a case, the controller 110 resets flag B in step S8 and terminates the sequential process flow. In this case, the controller 110 executes only two processes, that is, the first fluctuation control that cyclically changes the developing bias and the second fluctuation control that cyclically changes the charging bias out of above described three fluctuation controls in the subsequent image forming processing. Not executing the third fluctuation control avoids the increase of the residual cyclic fluctuation caused by the execution of the third fluctuation control using unsuitable third pattern data.

On the other hand, when the variations σ1 and σ2 in the image density fluctuation of the third test toner image is less than the corresponding threshold (Yes in step S13), it is possible to generate suitable third pattern data based on the image density fluctuation. That is, executing the third fluctuation control that cyclically changes the LD power according to the third pattern data can reduce the residual cyclic fluctuation. The controller 110 sets flag B, determines the execution of the third fluctuation control in step S14, and executes the third pattern data generation process in step S15 to generate the third pattern data that is the fluctuation pattern data of the fluctuating writing intensity. After generating the third pattern data for photoconductor cycle and that for sleeve cycle, the controller 110 terminates the sequential process flow.

In the regular adjustment control described above, a set of steps S4, S7, S8, S9, S10, S13, and S14 functions as the determination process. When the controller 110 determines not to execute the first fluctuation control (No in step S4) in the determination process, the controller 110 terminates the sequential process flow as follows. That is, as illustrated in FIG. 19, not executing the first pattern data generation process in step S5, the second detection process in step S6 to detect the image density fluctuation caused by executing the first fluctuation control, the second pattern data generation process in step S11 to generate the second pattern data that is the fluctuation pattern data of the fluctuating charging voltage, the third detection process in step S12 to detect the residual cyclic fluctuation, and the third pattern data generation process in step S15 to generate the third pattern data that is the fluctuation pattern data of the fluctuating writing intensity, the controller 110 terminates the sequential process flow. This means that the controller executes the subsequent image forming process without executing the above processes.

The reason why the controller 110 omits the above processes and terminates the sequential process is as follows. When skipping the first fluctuation control that cyclically changes the developing bias, the controller 110 does not execute the second fluctuation control that cyclically changes the charging bias and the third fluctuation control that cyclically changes the LD power. Thus, generation of three types of pattern data, that is, the first, second, and third pattern data is not needed. Therefore, when the controller 110 determines not to execute the first fluctuation control (No in step S4), the controller 110 skips not only the first pattern data generation process in step S5 which generates the first pattern data that is needed for execution of the first fluctuation control but also the second detection process in step S6, the second pattern process in step S11, the third detection process in step S12, and the third pattern process in step S15. When skipping the first fluctuation control, the controller 110 does not need to execute the second detection process to detect the image density fluctuation that is newly caused by the first fluctuation control. In addition, the controller 110 does not need to execute the second pattern process to generate the second pattern data which is necessary to execute the second fluctuation control that cyclically changes the charging bias. Skipping the above described processes and terminating the sequential process decreases downtime, energy consumption, and toner consumption caused by unnecessary execution of the above processes.

When the controller 110 determines not to execute the second fluctuation control that cyclically changes the charging bias (No in step S9) in the regular adjustment control, the controller 110 skips the second pattern process in step S11, the third detection process in step S12, and the third pattern process in step S15. Such control decreases downtime, energy consumption, and toner consumption caused by unnecessary execution of the second pattern process to generate the second pattern data that is necessary for execution of the second fluctuation control.

When the controller 110 determines not to execute the third fluctuation control that cyclically changes the LD power (No in step S13) in the regular adjustment control, the controller 110 skips the third pattern data generation process in step S15 and terminates the sequential processing flow. Such control decreases downtime, energy consumption, and toner consumption caused by unnecessary execution of the third pattern process to generate the third pattern data that is necessary for execution of the third fluctuation control.

Next, a feature of the copier 500 according to the embodiment is described below.

In the following embodiments, the first pattern data, the second pattern data, and the third pattern data are generated by a method different from the above-described method but may be generated by the method already described above.

The copier 500 according to the present embodiment performs frequency analysis on an average waveform obtained by averaging waveforms of a plurality of cycles and illustrated by a thick solid line in FIG. 14. The frequency analysis may be by Fast Fourier Transform (FFT) or orthogonal waveform detection. The copier 500 uses the orthogonal wave form detection, superimposes sine waves like the following equation, and expresses the average waveform.

$$f(t)=A1\times\sin(\omega t+\theta 1)+A2\times\sin(2\times\omega t+\theta 2)+A3\times\sin(3\times\omega t+\theta 3)+\ldots+A20\times\sin(20\times\omega t+\theta 20)$$

In the above equation, i is a natural number from 1 to 20;

f(t) is the average waveform of cutout waveforms of fluctuations in toner adhesion amount [$10^{-3}$ mg/cm$^2$];

Ai is an amplitude of sine wave [$10^{-3}$ mg/cm$^2$];

ω is an angular speed of a rotating body (the sleeve or the photoconductor) [rad/s]; and θi is a phase of the sine wave [rad].

Instead of the above described equation, the following equation may be used, $$f(t)=\Sigma Ai\times\sin(i\times\omega t+\theta i)$$

The above equation which illustrates the average waveform is determined for the photoconductor cycle. The amplitude Ai at the phase θi which is determined based on the equation is converted to a developing bias difference by using a converted equation that converts the amplitude Ai to the developing bias difference and is prepared in advance. Assigning the converted developing bias difference to the above equation leads to the first pattern data for the photoconductor cycle. Specifically, the following equation gives the first pattern data for the photoconductor cycle.

$$f(t)=\Sigma\text{bias amplitude}\times\sin(i\times\omega(t-t1)+\theta i)$$

In the above equation, t1 means a delay time given by a layout distance between a position which the test image is detected and a position which the test image is developed. The t1 is calculated from the layout distance and a process speed. Considering the delay time t1 makes it possible to compensate for affection of the layout distance. The first pattern data for the photoconductor cycle is calculated from t=0 to t=one photoconductor rotation cycle.

The first pattern data for sleeve cycle is calculated similarly by using the above equations. This correction is performed at the first pattern process described above.

Similar calculation method generates the second pattern data for photoconductor cycle, the second pattern data for sleeve cycle, the third pattern data for photoconductor cycle, and the third pattern data for sleeve cycle. The second pattern data is corrected by the above equation at the second pattern process described above. The third pattern data is corrected by the above equation at the third pattern process described above.

Figure 20:
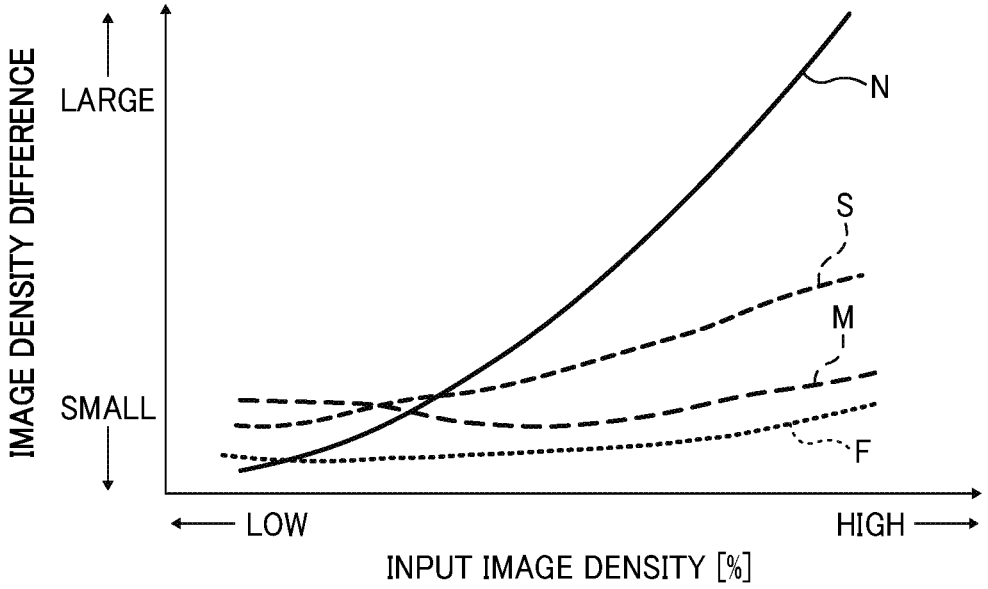
FIG. 20 is a graph illustrating relations between an input image density (an image density expressed by image data) and difference between an output image density and the input image density in some cases characterized by combination of some fluctuation control process.

FIG. 20 is a graph illustrating relations between an input image density (an image density expressed by image data) and an image density difference between an output image density and the input image density in some cases characterized by combination of some fluctuation control processes. In FIG. 20, a dotted line marked "F" illustrates a characteristics of the case in which all the fluctuation controls, that is, the first fluctuation control in which the developing bias is cyclically changed, the second fluctuation control in which the charging bias is cyclically changed, and the third fluctuation control in which the LD power is cyclically changed are executed. This case is called the first condition hereinafter. In addition, the case in which only the first fluctuation control and the second fluctuation control are executed is called the second condition.

Any of four characteristics in FIG. 20 have a tendency that the image density difference becomes bigger at higher input image density. In the solid image portion whose image density becomes largest, the image density difference becomes largest. (Hereinafter, the image density difference of the solid image portion is called a solid image density difference). Focusing on the solid image density difference and the combination of some fluctuation control process, FIG. 20 illustrates following things. That is, the solid image density difference becomes largest when the controller 110 does not execute all fluctuation controls that are the first fluctuation control in which the developing bias is cyclically changed, the second fluctuation control in which the charging bias is cyclically changed, and the third fluctuation control in which the LD power is cyclically changed, which is illustrated by a solid line marked "N" in FIG. 20. When the controller 110 executes all fluctuation control that are the first fluctuation control, the second fluctuation control, and the third fluctuation, the solid image density difference becomes smallest, which is illustrated by the dotted line marked "F" in FIG. 20.

To effectively reduce cyclical image density fluctuation of the high image density in the solid portion, the first pattern data to change the developing bias cyclically causes a bias cyclical fluctuation with a large amplitude. Since the large amplitude in the developing bias cyclical fluctuation causes a large amplitude of the cyclic fluctuation of the background potential, the second pattern data to change the charging bias cyclically generates a large amplitude of a charging bias cyclical fluctuation. Since skipping the third fluctuation control based on the third pattern data causes a large amplitude of a cyclic fluctuation of the developing potential caused by the cyclic change of the charging bias, the image density difference in the high image density solid portion becomes large.

Figure 21:
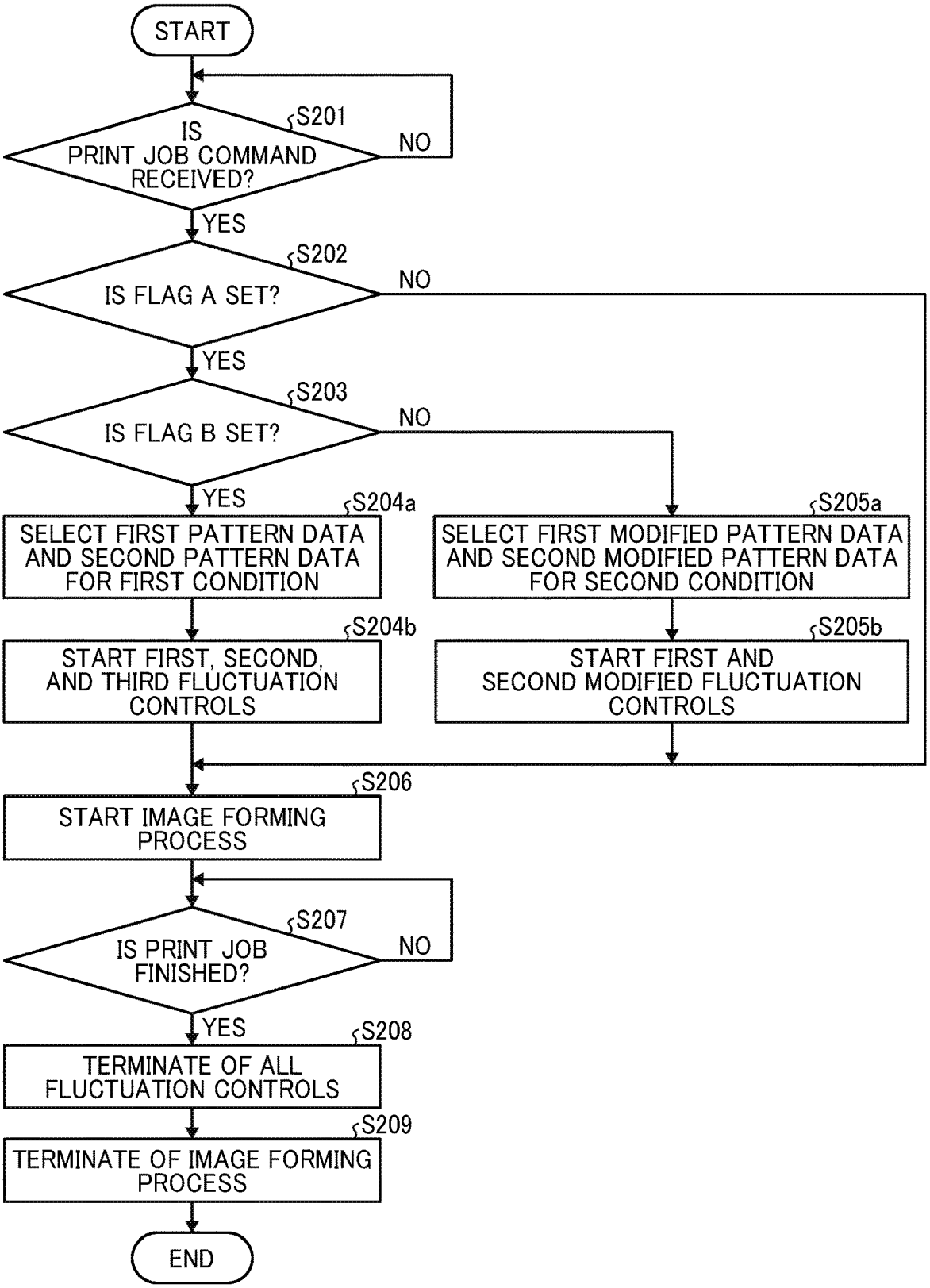
FIG. 21 is a flowchart illustrating steps in a process of a print job control performed by the controller of the image forming apparatus.

When the controller 110 uses a set of the first pattern data and the second pattern data, which is generated under assumption of the first condition that means execution of all fluctuation control, that is, the first to third fluctuation control, but employs the second condition that means executing only the first fluctuation control and the second fluctuation control, the image density difference in the solid portion becomes relatively larger. A dashed line marked "S" in FIG. 21 illustrates above described situation. Hereinafter, the first pattern data and the second pattern data, which is generated under assumption of the first condition that means execution of all fluctuation control, are called the first pattern data for the first condition and the second pattern data for the first condition.

The inventors have found that using the following set of the first modified pattern data and the second modified pattern data for the second condition makes it possible to decrease an image density difference in the solid portion under the second condition. The set of the first modified pattern data and the second modified pattern data for the second condition generates a smaller amplitude of the bias cyclical fluctuation than the one based on the first and second pattern data for the first condition. A dashed spaced line marked "M" in FIG. 20 illustrates a relation between the input image density and the image density difference in the second condition using above described set of the first modified pattern data and the second modified pattern data for the second condition. As illustrated in FIG. 20, the image density difference of the high image density portion of the line "M" is smaller than that of the line "S". That is, using the set of the first modified pattern data and the second modified pattern data for the second condition makes the image density difference of the high image density portion smaller.

Based on the above data, the controller 110 of the copier 500 according to the embodiment generates the first modified pattern data for the second condition that is given by multiplying a predetermined gain that is a factor less than one by each of the first pattern data for the first condition after generating the first pattern data for the first condition in the first pattern process (step S3 in FIG. 19). The first modified pattern data for the second condition is obtained by reducing amplitude of each phase in a bias fluctuation waveform corresponding to one cycle indicated by the first pattern data at a fixed ratio. Similarly, in the second pattern process, the controller 110 generates the second modified pattern data for the second condition that is given by multiplying a predetermined gain by each of the second pattern data for the first condition after generating the second pattern data for the first condition (step 11 in FIG. 19). When the controller 110 employs the first condition, the controller 110 cyclically changes the developing bias using the first pattern data for the first condition in the first fluctuation control and cyclically changes the charging bias using the second pattern data for the first condition in the second fluctuation control (step S204*a* and step S204*b* in FIG. 21 described later). On the other hand, when the controller 110 employs the second condition, the controller 110 cyclically changes the developing bias using the first modified pattern data for the second condition in a first modified fluctuation control and cyclically changes the charging bias using the second modified pattern data for the second condition in a second modified fluctuation control (step S205*a* and step S205*b* in FIG. 21).

The controller 110 saves the first pattern data, the second pattern data, and the third pattern data, which are generated in steps S3, S11, and S15 in FIG. 19, the data indicating the state of the flag A which is set in steps S7 and S10, and the data indicating the state of the flag B in the nonvolatile memory of the controller 110. These data are referred to in the processing flow of FIG. 21 described later. FIG. 21 is a flowchart illustrating steps in a process of a print job control performed by the controller 110. In this process flow, when the controller 110 receives a print job command (Yes in step S201), the controller 110 determines whether the flag A is set in step S202. When the flag A is not set (No in step S202), the controller 110 skips the first fluctuation control, the second fluctuation control, and the third fluctuation control, starts the image forming processing (step S206), and executes a print job relating to the print job command. After the print job finishes (Yes in step S207), the controller 110 terminates the image forming process in step S209. In FIG. 21, prior to step S209, a step in which all the fluctuation control (e.g., the first to third fluctuation controls) are terminated is illustrated (step S208), but, because the controller 110 executes the image forming process without executing all the fluctuation control when the flag A is not set (No in step S202), the controller 110 does not execute step S208 substantially.

On the other hand, when the flag A is set (Yes in step S202), the controller 110 determines whether the flag B is set in step S203. When the flag B is set (Yes in step S203), the controller 110 selects the first pattern data and the second pattern data for the first condition in step S204*a* and starts the first fluctuation control, the second fluctuation control, and the third fluctuation control under the first condition in step S204*b*. After that, the controller 110 starts the image forming process (step S206). Thus, while each of the developing bias, the charging bias, and the LD power is changed cyclically, an image based on the user's command is formed.

When the flag B is not set (No in step S203), the controller 110 selects the first pattern data and the second pattern data for the second condition in step S205*a* and starts only the first fluctuation control and the second fluctuation control of the three fluctuation controls in step S205*b*. After that, the controller 110 starts the image forming process (step S206). Thus, while each of the developing bias and the charging bias of the three image forming conditions is changed cyclically, the image based on the user's command is formed.

In the above-described control, compared with the case in which the controller 110 executes the second condition using the first pattern data and the second pattern data for the first condition, the image density difference in the solid portion becomes smaller. That is, the above-described control prevents deterioration of the image density fluctuation caused when the LD power among the charging bias, the developing bias, the charging bias, and the LD power cannot be appropriately periodically controlled.

Although the controller 110 determines whether the controller 110 executes the first fluctuation control in step S4 in FIG. 19 based on the variations $\sigma 1$ and $\sigma 2$ (detection results in step S3 in FIG. 19) in the image density fluctuation of the first test toner image, the controller 110 may execute the following determination process. That is, when the controller 110 forms a solid test toner image while executing only the first fluctuation control according to the first pattern data generated based on the image density fluctuation with the large variations $\sigma 1$ and $\sigma 2$ and executes the second detection process in step S6 in FIG. 19, an image density fluctuation detected in the second detection process generally has the large variations $\sigma 1$ and $\sigma 2$. Therefore, after the first detection process in step S3 in FIG. 19, the controller 110 may skip step S4 in FIG. 19 in which the controller 110 determines whether the detected variations are small and execute the first pattern data generation process in step S5 in FIG. 19 and the second detection process in step S6 in FIG. 19. Then, based on the variations $\sigma 1$ and $\sigma 2$ of the image density fluctuation acquired in the second detection process, the controller 110 may determine whether the controller 110 executes both the first fluctuation control in which the controller 110 cyclically changes the development bias and the second fluctuation control in which the controller 110 cyclically changes the charge bias. When either the variations $\sigma 1$ or the variations $\sigma 2$ is equal to or greater than the corresponding threshold, the controller 110 skips the third detection process in step S12 in FIG. 19 and the third pattern process in step S15 in FIG. 19 and terminates the regular adjustment control. Such control avoids downtime, energy consumption, and toner consumption caused by unnecessary execution of above steps.

In the above-described embodiment, the controller 110 determines, in step S9 in FIG. 19, whether the controller 110 executes the second fluctuation control based on the variations σ1 and σ2 in the image density fluctuation of the second test toner image which is the result detected in step S6 in FIG. 19, but the controller 110 may execute the following determination process. That is, when the controller 110 determines the variations σ1 and σ2 in the image density fluctuation of the first test toner image (Yes in step S4), the controller 110 may skip the determination process in step S9 and setting flag A in step S10 after execution of the first pattern data generation process in step S5 and the second detection process in step S6. Then, the controller 110 executes the second pattern data generation process in step S11 and the third detection process in step S12. Prior to step S12, when the variations σ1 and σ2 in the image density fluctuation in the second test toner image detected in the second detection process in step S6 are large, the variations σ1 and σ2 in the image density fluctuation in the third test toner image detected in step S12 are generally determined large. Therefore, based on the variations σ1 and σ2 in the image density fluctuation in the second test image, the controller 110 may determine whether to perform the second fluctuation control, that is, whether to set or release the flag A. When either the variations σ1 or σ2 in the image density fluctuation in the third test toner image is equal to or greater than the corresponding threshold, the controller 110 skips the second fluctuation control in which the charging bias is cyclically changed and the third fluctuation control in which the LD power is cyclically changed, that is, the controller 110 resets both the flag A and the flag B. After that, the controller 110 skips the third pattern data generation process in step S15 and terminates the regular adjustment control. Such control avoids downtime and energy consumption caused by unnecessary execution of the third pattern process.

In the above-described embodiment, the controller 110 determines, in step S13 in FIG. 19, whether the controller 110 executes the third fluctuation control based on the result detected in step S12 in FIG. 19, but the controller 110 may execute the following determination process. That is, after executing the third detection process in step S12 in FIG. 19, the controller 110 skips the determination process in step S13 and setting flag B in step S14 and executes the third pattern data generation process in step S15. After that, the controller 110 forms the third test toner image while executing the first fluctuation control in which the developing bias is cyclically changed, the second fluctuation control in which the charging bias is cyclically changed, and the third fluctuation control in which the LD power is cyclically changed. When either the variations σ1 or σ2 in the image density fluctuation in the third test toner image is equal to or greater than the corresponding threshold, the controller 110 may skip the third fluctuation control and reset the flag B.

When a resistance unevenness is in the circumferential direction on a charging roller (for example, the charging roller 71Y), even if the charging roller charges a photoconductor (e.g., the photoconductor 20Y) with the constant charging bias, uneven charging of the photoconductor due to the resistance unevenness occurs. Due to the uneven charging, a cyclic image density fluctuation occurs in a halftone portion of a print image. Therefore, the charging bias may be cyclically changed based not only on the second pattern data for photoconductor cycle and that for sleeve cycle but also on fourth pattern data corresponding to the resistance unevenness for charging roller cycle.

Specifically, the charging roller is provided with a charging roller rotation sensor to detect the charging roller being in the predetermined rotation attitude. While the charging roller 71 is applied a predetermined constant charging bias, a fourth test image is formed. Based on the fourth test image, the cyclic image density fluctuation caused by the resistance unevenness on the charging roller 71 is detected. The controller 110 generates the fourth pattern data as the charging bias pattern to offset the cyclic image density fluctuation based on the detected result. In the second fluctuation control, the following three types of charging bias output difference are superimposed and controlled as the charging bias output. The first type of the charging bias output difference is determined based on the second pattern data for photoconductor cycle and the photoconductor reference attitude timing. The second type of the charging bias output difference is determined based on the second pattern data for sleeve cycle and the sleeve reference attitude timing. The third type of the charging bias output difference is determined based on the fourth pattern data and a charging roller reference attitude timing.

As described above, when the resistance unevenness in the circumferential direction on the charging roller causes the image density fluctuation occurring in the charging roller rotation cycle, the controller 110 analyzes the image density fluctuation occurring in the charging roller rotation cycle and generates the fourth pattern data based on the analysis. Based on the fourth pattern data in addition to the second pattern data for photoconductor cycle and that for sleeve cycle, the controller 110 cyclically changes the charging bias. The controller 110 may analyze the image density fluctuation occurring in the charging roller rotation cycle in the first test toner image described above, generate the first pattern data for the charging roller rotation cycle based on the analysis, and cyclically change the developing bias based on the first pattern data for the charging roller rotation cycle. The controller 110 may analyze the image density fluctuation occurring in the charging roller rotation cycle in the third test toner image described above, generate the third pattern data for the charging roller rotation cycle based on the analysis, and cyclically change the LD power based on the third pattern data for the charging roller rotation cycle.

In the above-described description, the controller 110 generates the first pattern data for the first condition and the first pattern data for the second condition in the first pattern data generation process in step S5 of FIG. 19 and, in the second pattern data generation process in step S11, generates the second pattern data for the first condition and the second pattern data for the second condition, but the controller 110 may generate the pattern data as follows. The controller 110 may generate only the first pattern data for the first condition in the first pattern data generation process in step S5 and, in the second pattern data generation process in step S11, may generate only the second pattern data for the first condition. When the controller 110 employs the second condition (No in step S13 and proceeds step S8), the controller 110 corrects the first pattern data for the first condition and the second pattern data for the first condition which are generated above and generates the first pattern data for the second condition and the second pattern data for the second condition.

Next, description will be given of variations of an image forming apparatus in which the configuration of a part of the image forming apparatus according to the embodiment is modified. Other than the differences described below, the configuration in the variations are similar to the configuration in the embodiment.

Variation A

The variation A may be applied to the image forming apparatus such as the copier illustrated in FIG. 1. In the variation A, the controller 110 cyclically changes only LD power and reduces the cyclical image density fluctuation when the controller 110 does not cyclically change the developing bias or the charging bias because the controller 110 cannot generate the suitably fluctuation pattern data of the developing bias and the suitable fluctuation pattern data of the charging bias.

When the controller 110 corrects a reference value of the LD power (writing intensity) of the laser writing device 21 in FIG. 1 to raise the image density lower than a target image density in the solid image whose area coverage modulation is 100% to the target image density, this correction may cause increase of the image density in the halftone image whose area coverage modulation is 50% and a deviation from the target image density in the halftone image. This is because the proper reference value of the LD power differs according to the image density, that is, the area coverage modulation ratio. This makes it difficult to set an appropriate image density in each image portion of an image area in which image portions of different image densities coexist.

On the other hand, the present inventors found that the cyclical image density fluctuation caused by a variation in a development gap due to an eccentricity or a bent surface of the photoconductor or the developing sleeve becomes noticeable in an image density area in which the area coverage modulation ratio is from 30% to 70%. Therefore, when the controller 110 cyclically changes only LD power out of the developing bias, the charging bias, and the LD power to reduce the cyclical image density fluctuation, a following control is preferable. That is, the controller 110 does not generate the third pattern data from the third test toner image made of solid image whose area coverage modulation ratio is 100% or halftone image whose area coverage modulation ration is low. The controller 110 generates the third pattern data from the third test toner image made of halftone image whose area coverage modulation ratio is from 30% to 70%, preferably 40% to 60%. More preferably, the controller 110 generates the third pattern data from the third test toner image made of halftone image whose area coverage modulation ratio is 50%.

Figure 22:
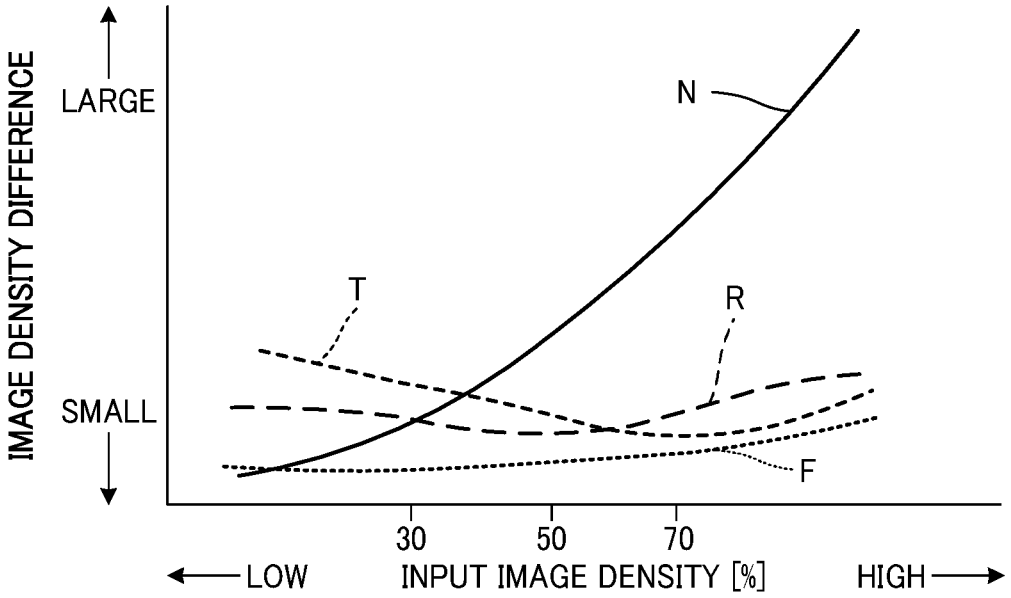
FIG. 22 is a graph illustrating relations between the input image density and difference between the output image density and the input image density in some conditions of some fluctuation control process.

FIG. 22 is a graph illustrating relations between the input image density (the image density expressed by image data) and the image density difference between the output image density and the input image density in some cases characterized by combination of some fluctuation control processes. In FIG. 22, a dotted line marked "F" illustrates the characteristics of the first condition in which all three parameters, that is, the developing bias, the charging bias, and the LD power are cyclically changed. Specifically, in the first condition, the controller 110 executes the first fluctuation control in which the developing bias cyclically changed, the second fluctuation control in which the charging bias cyclically changed, and the third fluctuation control in which the LD power is cyclically changed. Additionally, in a third condition, the controller 110 cyclically changes only the LD power among the developing bias, the charging bias, and the LD power. That is, the controller 110 executes only the third fluctuation control among the first fluctuation control, the second fluctuation control, and the third fluctuation control.

The third pattern data for the first condition is the fluctuation pattern data of the LD power generated on the premise that the developing bias, the charging bias, and the LD power are cyclically changed. As in the description of the embodiment, the controller 110 generates the third pattern data based on the result of detecting the image density fluctuation in the third test toner image whose area coverage modulation ratio is 70% to reduce the residual cyclic fluctuation. A short dashed line marked "T" in FIG. 22 illustrates a relation between the input image density and the image density difference between the input image density and the output image density when the controller 110 uses the fluctuation pattern data of the LD power for the first condition and executes the third condition, that is, when the controller 110 cyclically changes only the LD power. As illustrated in FIG. 22, the image density difference at 70% of the area coverage modulation ratio becomes lowest. However, since the area coverage modulation ratio range in which the image density fluctuation is conspicuously noticeable is from 30% to 70%, use of the fluctuation pattern data of the LD power for the first condition is not perfect in reducing the image density fluctuation visually recognized by the user.

A long-dashed line marked "R" in FIG. 22 illustrates a relation between the input image density and the image density difference when the controller 110 uses the third pattern data for the third condition to cyclically change the LD power. The third pattern data for the third condition is the fluctuation pattern data of the LD power generated to cyclically change only the LD power among the developing bias, the charging bias, and the LD power. The third pattern data for the third condition is generated based on the result of detecting the image density fluctuation in the third test toner image whose area coverage modulation ratio is 70%, which is similar to the third pattern data for the first condition, but the image forming condition of this third test toner image for the third condition is different from that for the first condition. In addition, the method of generating the third pattern data for the third condition is different from that for the first condition.

Specifically, when the controller 110 generates the third pattern data for the third condition, that is, the third pattern data for cyclically changing the LD power, the controller 110 forms the third test toner image without cyclically changing the developing bias, the charging bias, and the LD power. Therefore, the cyclic image density fluctuation occurring in the third test toner image when the controller 110 generates the third pattern data for the third condition becomes the image density fluctuation caused by the variation in the development gap and does not include the residual cyclic fluctuation. Based on the result of detecting the image density fluctuation in the third test image, the controller 110 generates the third pattern data for effectively reducing the image density fluctuation in the third test toner image which is the toner image having the area coverage modulation ratio=70%. The third pattern data is corrected by multiplying each data by a gain that is a factor less than one. This correction changes the third pattern data to reduce the amplitude of the LD power fluctuation waveform by a constant fraction at each phase in one period and effectively reduce the image density fluctuation in the toner image having the area coverage modulation ratio=50%, not having the area coverage modulation ratio=70%. The result of the correction based on the third pattern data for the third condition is illustrated the long-dashed line marked "R" in FIG. 22.

Execution of the third condition in which only the LD power is cyclically changed by using the third pattern data for the third condition to cyclically change the LD power effectively reduces the image density difference in the area coverage modulation ratio range from 30% to 70% illustrated in FIG. 22. Therefore, compared with the case in which the controller 110 executes the third condition using the LD fluctuation pattern data for the first condition, the image density difference noticeable for the user can be reduced.

Figure 23:
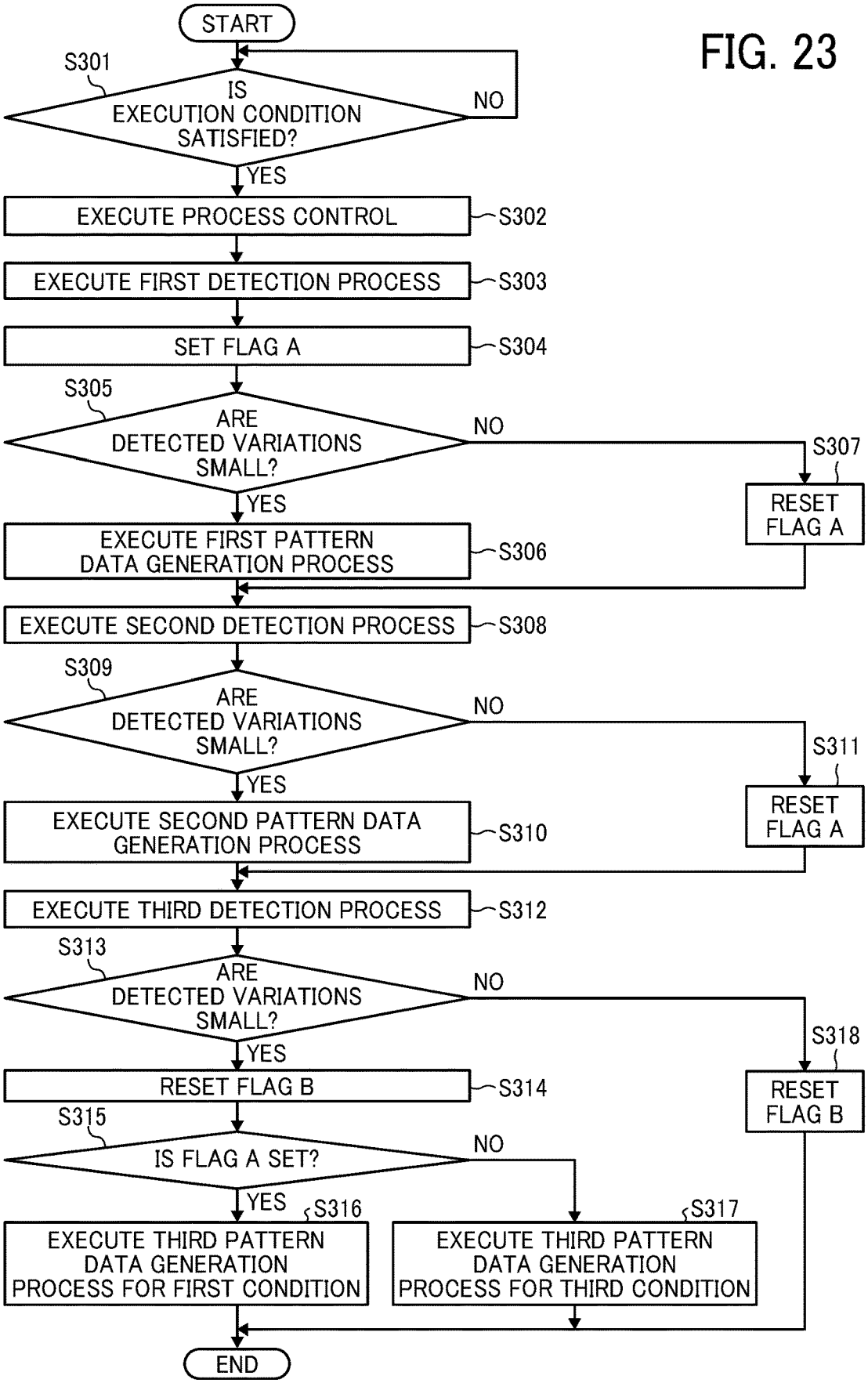
FIG. 23 is a flowchart illustrating steps in a process of a regular adjustment control performed by a controller of the image forming apparatus according to a variation A.

FIG. 23 is a flowchart illustrating steps in a process of a regular adjustment control as an image forming condition adjustment control regularly performed by the controller 110 of the image forming apparatus according to the variation A. In FIG. 23, the flow from S301 to S303 is the same as the flow from S1 to S3 in FIG. 19. After the controller 110 executes the first detection process in step S303 and sets the flag A in step S304, the controller 110 determines whether either the variations σ1 or the variations σ2 in the image density fluctuation detected in the first detection process is smaller than the corresponding threshold in step S305. When the variations σ1 and the variations σ2 are smaller than the corresponding threshold (Yes in step S305), the controller 110 executes the first pattern data generation process in step S306 and the second detection process in step S308. When either the variations σ1 or the variations σ2 is equal to or larger than the corresponding threshold (No in step S305), the controller 110 resets the flag A in step S307 and executes the second detection process in step S308. When either the variations σ1 or the variations σ2 is equal to or larger than the corresponding threshold, the first pattern data for cyclically changing the developing bias does not exists. Therefore, the controller 110 forms the second test toner image under the constant developing bias reference value.

When the variations σ1 and the variations σ2 which are obtained in the second detection process are smaller than the corresponding threshold (Yes in step S309), the controller 110 executes the second pattern data generation process to generate the second pattern data for cyclically changing the charging bias in step S310 and executes the third detection process in step S312. When either the variations σ1 or the variations σ2 is equal to or larger than the corresponding threshold (No instep S309), the controller 110 resets the flag A in step S311 and executes the third detection process in step S312.

When the flag A is set, in the third detection process, the controller 110 forms the third test toner image while cyclically changing the developing bias based on the first pattern data and the charging bias based on the second pattern data. When the flag A is reset, in the third detection process, the controller 110 forms the third test toner image under the constant developing bias reference value and the constant charging bias reference value without cyclically changing the developing bias and the charging bias.

When either the variations σ1 or the variations σ2 obtained in the third detection process is equal to or larger than the corresponding threshold (No in step S313), the controller 110 resets the flag B in step S318 and terminates the sequential process flow.

When the variations σ1 and the variations σ2 which are obtained in the third detection process are smaller than the corresponding threshold (Yes in step S313), the controller 110 sets the flag B in step S314 and determines whether the flag A is set in step S315. When the flag A is set (Yes in step S315), the controller 110 executes the third pattern data generation process for the first condition in step S316, and when the flag A is not set (No in step S315), the controller 110 executes the third pattern data generation process for the third condition in step S317.

In the third pattern data generation process for the first condition in step S316, the controller 110 generates the third pattern data that is the LD fluctuation pattern data to reduce the residual cyclic fluctuation like the third pattern data generation process in the above-described embodiment. The third pattern data expresses the fluctuation pattern data obtained by superimposing a fluctuated LD power that is the fluctuating writing intensity on the constant LD power that is the predetermined writing intensity. On the other hand, in the third pattern data generation process in step S317 for the third condition in which only the LD power is cyclically changed, the controller 110 generates the third pattern data to reduce the image density fluctuation caused by the cyclic development gap fluctuation without cyclically changing the developing bias and the charging bias. The controller 110 sets the gain to convert the image density fluctuation into the LD fluctuation pattern so that the amplitude of the LD fluctuation pattern obtained in step S317 is smaller than the amplitude of the LD fluctuation pattern obtained in the third pattern data generation process for the first condition. This process generates the LD fluctuation pattern focused on the image density corresponding to the area coverage modulation ratio=50% and makes it possible to effectively reduce the image density fluctuation in the area coverage modulation ratio range from 30% to 70%. The controller 110 can cyclically change the LD power based on the third pattern data which can prevent increase of the image density fluctuation caused by not being able to cyclically change the developing bias and the charging bias among the developing bias, the charging bias, and the LD power.

Figure 24:
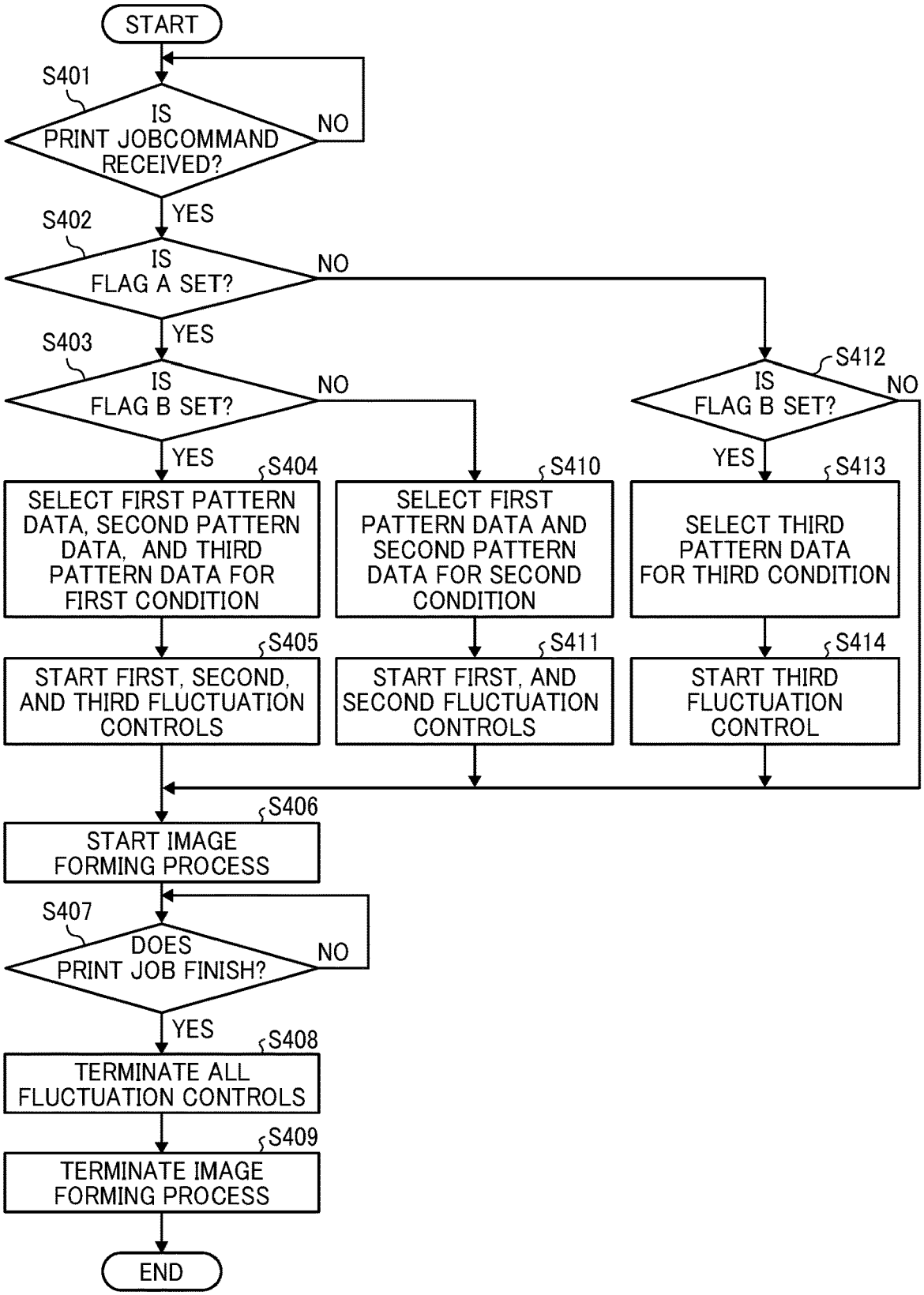
FIG. 24 is a flowchart illustrating steps in a process of a print job control performed by the controller of the image forming apparatus.

The higher the image density in the detected portion is, (that is, the larger the toner adhesion amount in the detected portion is) the larger the variations of the reading of the image density tends to become. Therefore, the following phenomenon generally occurs. That is, the variations of the readings in the first detection process in which the image density fluctuation in the solid first test toner image is detected becomes large, but the variations of the readings in the second detection process in which the image density fluctuation in the second test toner image having the area coverage modulation ratio=50% becomes small. In addition, while the variations of the reading in the first detection process becomes large, the variations of the reading in the third detection process in which the image density fluctuation in the third test toner image having the area coverage modulation ratio=70% may generally become small. FIG. 24 is a flowchart illustrating steps in a process of a print job control performed by the controller 110 of the copier 500 according to the variation A. In this process flow, when the controller 110 receives a print job command (Yes in step S401), the controller 110 determines whether the flag A is set in step S402. When the flag A is set (Yes in step S402), the controller 110 determines whether the flag B is set in step S403. When the flag B is also set (Yes in step S403), the controller 110 selects the first pattern data, the second pattern data, and the third pattern data in step S404. In step S405, after the controller 110 starts the first fluctuation control, the second fluctuation control, and the third fluctuation control, that is, the first condition in step S405, the controller 110 starts the image forming process in step S406. Thus, while each of the developing bias, the charging bias, and the LD power is changed cyclically, an image based on the user's command is formed. After the print job finishes (Yes in step S407), the controller 110 terminates all fluctuation control in step S408 and the image forming process in step S409. Then the controller 110 terminates the sequential process flow.

On the other hand, when the flag B is not set (No in step S403), the controller 110 selects the first pattern data for the second condition and the second pattern data for the second condition in step S412 and starts only the first fluctuation control and the second fluctuation control of the three fluctuation controls, that is, the second condition in step S411. After that, the controller 110 executes the process flow from step S406 to S409. Thus, while each of the developing bias and the charging bias of the three image forming conditions is cyclically changed, the image based on the user's command is formed.

On the other hand, when the flag A is not set (No in step S402), the controller 110 determines whether the flag B is set in step S412. When the flag B is set (Yes in step S412), the controller 110 selects the third pattern data for the third condition in step S413 and starts only the third fluctuation control among the three fluctuation controls in step S414. After that, the controller 110 executes the process flow from step S406 to step S409. The controller 110 can cyclically change the LD power based on the third pattern data which can prevent increase of the image density fluctuation caused by not being able to cyclically change the developing bias and the charging bias.

Variation B

The variation B may be applied to the image forming apparatus such as the copier illustrated in FIG. 1. The copier according to the variation B employs the following structure in addition to the copier according to the variation A.

Figure 25:
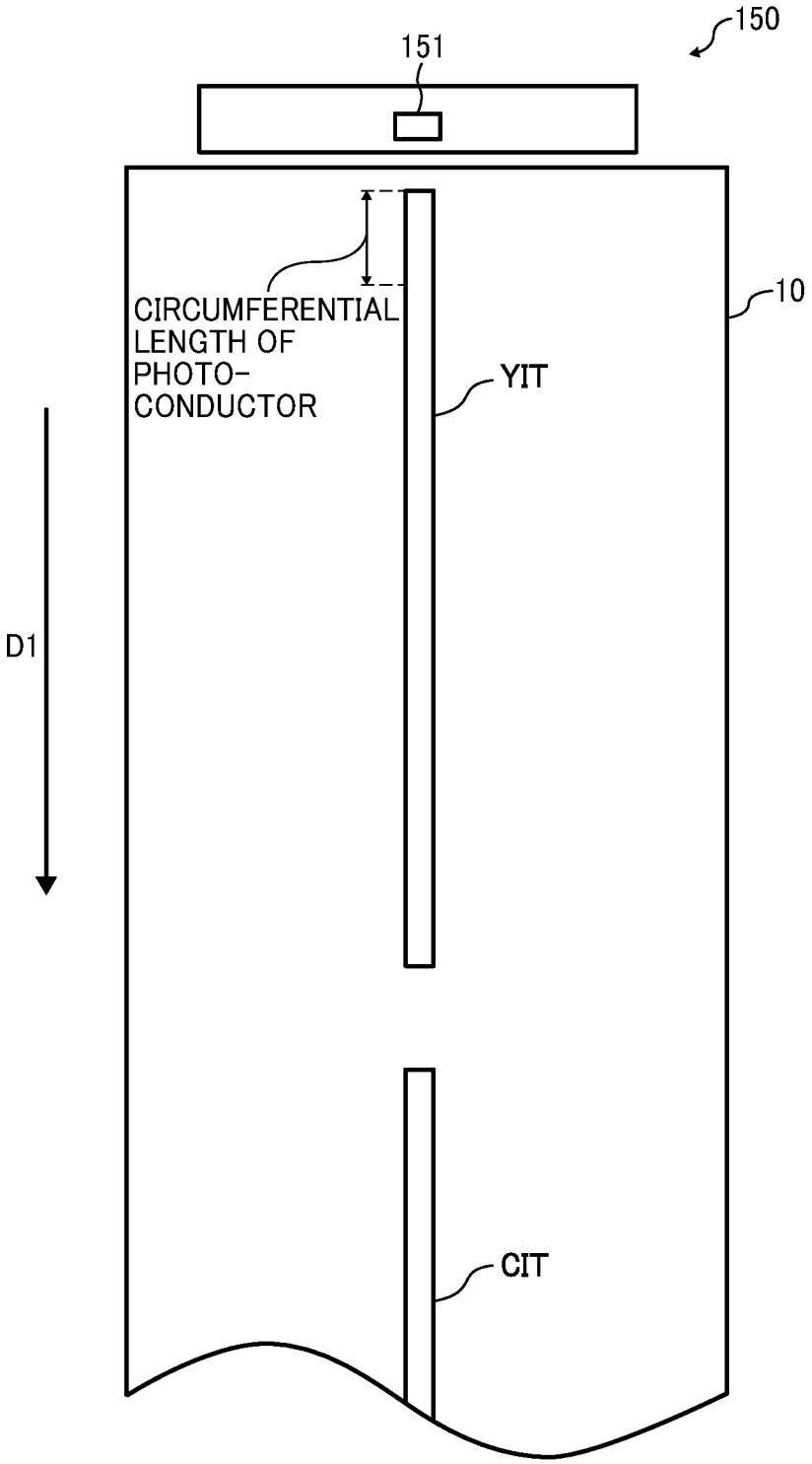
FIG. 25 is a schematic plan view of a first test toner image of each color on the intermediate transfer belt of the image forming apparatus according to a variation B.

FIG. 25 is a schematic plan view of the first test toner images of yellow and cyan transferred onto the intermediate transfer belt 10 of the image forming section in the copier according to the variation B. In FIG. 25, the yellow first test toner image YIT and the cyan first test toner image CIT are aligned in a straight line from the downstream side to the upstream side in the belt moving direction D1. The magenta first test toner image is aligned behind the cyan first test toner image, that is, upstream side in the belt moving direction D1 in the straight line extending in the belt moving direction D1. Further, the black first test toner image is aligned behind the magenta first test toner image in the straight line extending in the belt moving direction D1. The optical sensor unit 150 in FIG. 25 has only one reflective photosensor 151. The reflective photosensor 151 detects the image density (that is, the toner adhesion amount) of the test toner images for each color of yellow, cyan, magenta, and black.

Variation C

The variation C may be applied to the image forming apparatus such as the copier illustrated in FIG. 1. The copier according to the variation C employs the following structure in addition to the copier according to the variation A.

Figure 26:
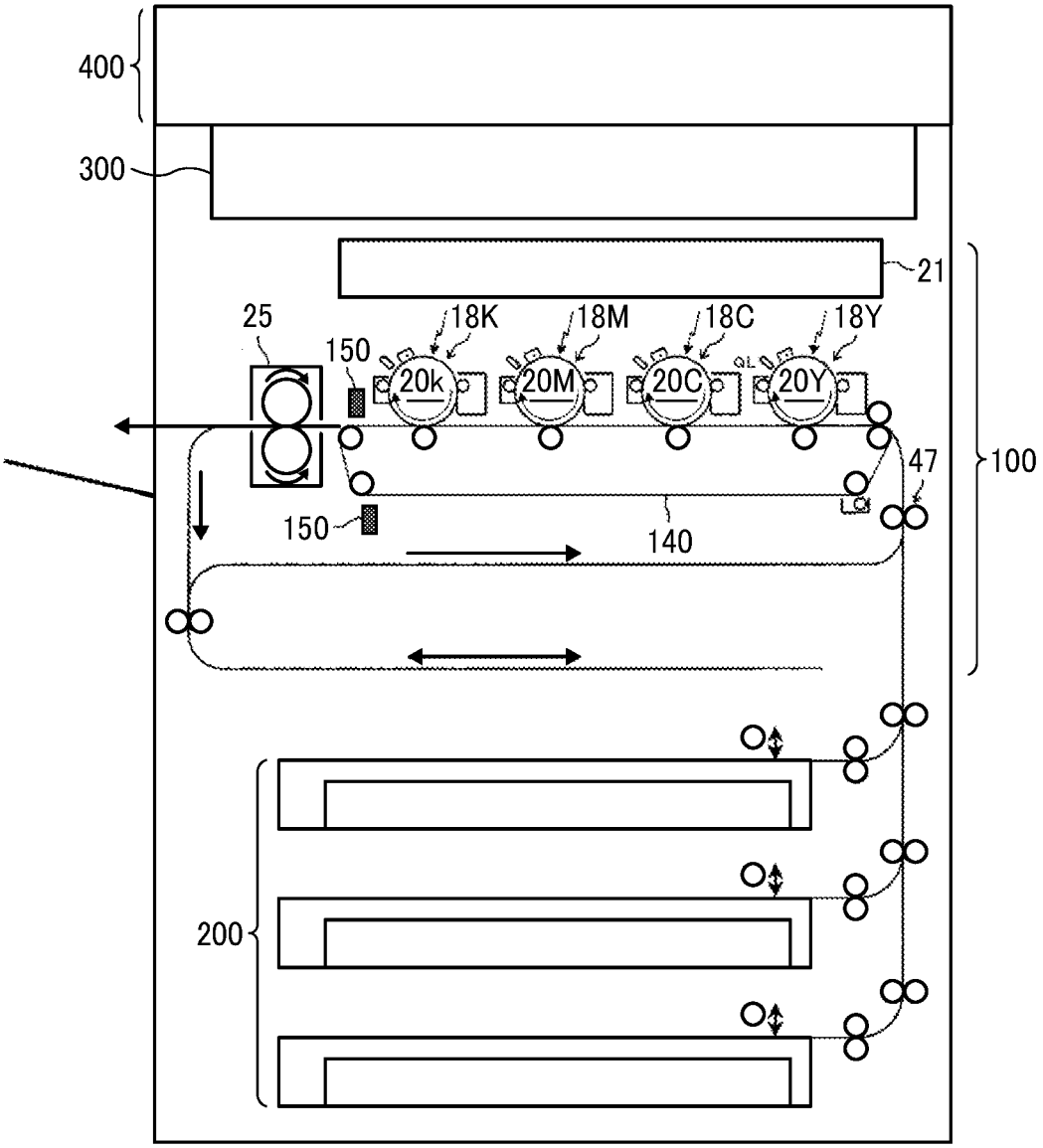
FIG. 26 is a schematic diagram illustrating an image forming apparatus according to a variation C.

FIG. 26 is a schematic diagram illustrating a copier according to the variation C. The copier in FIG. 26 employs a sheet conveyance belt 140 instead of the intermediate transfer belt, which are rotatable belt. Like the intermediate transfer belt of the copier according to the embodiment, the sheet conveyance belt 140 contacts the photoconductors 20Y, 20C, 20M, and 20K and forms the primary transfer nip.

The registration roller pair 47 sends the recording sheet toward an upper surface of the sheet conveyance belt 140. The recording sheet held on the upper surface of the sheet conveyance belt pass through the primary transfer nips for yellow, cyan, magenta, and black in this order as the sheet conveyance belt rotates. Thus, a yellow toner image, a cyan toner image, a magenta toner image, and a black toner image formed on the photoconductors 20Y, 20C, 20M, and 20K respectively are directly primarily transferred onto the recording sheet.

The configurations according to the above-described embodiment and variations are not limited thereto. This disclosure can achieve the following aspects effectively.

First Aspect

In the first aspect, the image forming apparatus such as the copier 500 includes the latent image bearer such as the photoconductor 20, the charger 70 to charge the surface of the latent image bearer such as photoconductor 20 with a superimposed charging bias obtained by superimposing a fluctuating charging voltage to reduce an image density fluctuation on a direct current charging voltage, a writing device such as the laser writing device 21 to write a latent image on the charged surface of the latent image bearer such as the photoconductor 20 with superimposed writing intensity obtained by superimposing fluctuating writing intensity to reduce an image density fluctuation on constant writing intensity, the developing sleeve 81 to which the superimposed developing bias obtained by superimposing the fluctuating developing voltage to reduce the image density fluctuation on the direct current developing voltage is applied to develop the latent image with the developer, and the circuitry such as the controller 110 to control the superimposed charging bias, the superimposed writing intensity, and the superimposed developing bias. The circuitry such as the controller 110 changes the fluctuating charging voltage and the fluctuating developing voltage between when the writing device writes the latent image with the superimposed writing intensity and when the writing device writes the latent image with the constant writing intensity.

In the first aspect, the fluctuating developing voltage corresponding to the image density fluctuation reduces the cyclic image density fluctuation in the solid image portion. The fluctuation of the background potential caused by the fluctuating developing voltage may cause the image density fluctuation in the halftone image portion, but the fluctuating charging voltage reduces such image density fluctuation in the halftone image portion. Further, the fluctuation of the developing potential caused by the fluctuating charging voltage may cause "a new image density fluctuation", but the fluctuating writing intensity reduces the new image density fluctuation.

As described above, in the first aspect, the fluctuating developing bias, the fluctuating charging voltage, and the fluctuating writing intensity can effectively reduce the cyclic image density fluctuation. However, when the circuitry such as the controller 110 cannot generate the suitable pattern data of the fluctuating writing intensity corresponding to the new image density fluctuation, and the writing device cannot cyclically change the writing intensity, the new image density fluctuation occurs. The new image density fluctuation may become relatively large for the following reasons: The fluctuation of the background potential caused by the developing bias, which fluctuates with a large amplitude corresponding to the image density fluctuation, can be offset and stabilized by the fluctuation of the charging bias. The fluctuation of the developing potential caused by the charging bias, which fluctuates with a large amplitude corresponding to the large amplitude of the developing bias, can be offset and stabilized by the fluctuation of the writing intensity. As a result, the image density fluctuation can be reduced efficiently. However, when the writing device cannot change the writing intensity, the fluctuation of the writing intensity cannot cancel the fluctuation of the developing potential.

Then, the fluctuation of the developing potential which fluctuates with a large amplitude may cause the large image density fluctuation.

The circuitry such as the controller 110 according to the first aspect changes the fluctuation pattern of the developing bias and the fluctuation pattern of the charging bias between when the superimposed writing intensity obtained by superimposing the fluctuating writing intensity on the constant writing intensity fluctuates and when the writing intensity keeps constant and does not fluctuate. This makes it possible for the amplitudes of the fluctuations in the developing bias and the charging bias when the writing intensity does not fluctuate to be set smaller than the developing bias and the charging bias when the writing intensity fluctuates. This may cause the small image density fluctuation because the amplitude of the developing bias is smaller than a suitable value, but total image density fluctuation becomes small because this leads the new image density fluctuation described above to be small. Therefore, the circuitry according to the first aspect reduces the image density fluctuation caused when the writing device cannot vary the writing intensity.

Second Aspect

In the image forming apparatus according to the first aspect, the image forming apparatus according to the second aspect includes a sensor such as the photosensor 151 to detect the image density fluctuation in a test image such as the test toner image. In the second aspect, the developing sleeve 81 to which the direct current developing voltage is applied forms a first test image, the sensor detects the image density fluctuation in the first test image, the circuitry such as the controller 110 generates pattern data of the fluctuating developing bias when the writing device writes the latent image with the superimposed writing intensity and pattern data of the fluctuating developing bias when the writing device writes the latent image with the constant writing intensity, the developing sleeve 81 to which the superimposed developing is applied forms a second test image, the sensor detects the image density fluctuation in the second test image, and the circuitry such as the controller 110 generates pattern data of the fluctuating charging bias when the writing device writes the latent image with the superimposed writing intensity and pattern data of the fluctuating charging bias when the writing device writes the latent image with the constant writing intensity based on the image density fluctuation in the second test image. The image forming apparatus according to the second aspect has the pattern data of the fluctuating developing bias, the pattern data of the fluctuating charging bias, and writing intensity data when the writing device writes the latent image with the superimposed writing intensity and the pattern data of the fluctuating developing bias, the pattern data of the fluctuating charging bias and writing intensity data when the writing device writes the latent image with the constant writing intensity. This makes it possible to quickly start the image forming operation when the writing device writes the latent image with the constant writing intensity instead of the superimposed writing intensity.

Third Aspect

In the third aspect, the image forming apparatus such as the copier 500 includes the latent image bearer such as the photoconductor 20, the charger 70 to charge the surface of the latent image bearer such as photoconductor 20 with a superimposed charging bias obtained by superimposing a fluctuating charging voltage to reduce an image density fluctuation on a direct current charging voltage, the writing device to write a latent image on the charged surface of the latent image bearer such as the photoconductor 20 with superimposed writing intensity obtained by superimposing fluctuating writing intensity to reduce an image density fluctuation on constant writing intensity, the developing sleeve 81 to which the superimposed developing bias obtained by superimposing a fluctuating developing voltage to reduce the image density fluctuation on the direct current developing voltage is applied to develop the latent image with the developer, and the circuitry such as the controller 110 to control the superimposed charging bias, the superimposed writing intensity, and the superimposed developing bias. The circuitry such as the controller 110 changes the fluctuating writing intensity between when the fluctuating charging voltage and the fluctuating developing voltage are supplied and when the fluctuating charging voltage and the fluctuating developing voltage are not supplied.

When the circuitry such as the controller 110 cannot generate the suitable pattern data of the fluctuating developing bias corresponding to the image density fluctuation, and the developing bias cannot be cyclically changed, there is no needs to change the developing bias because the fluctuation of the background potential caused by the fluctuation of the developing bias does not occur and to change the writing intensity because the fluctuation of the developing potential caused by the fluctuation of the developing bias does not occur. However, not changing any of the developing bias, the charging bias, and the writing intensity makes it impossible to reduce the image density fluctuation.

In the third aspect, even when the developing bias cannot be changed, the writing device writes the latent image with the superimposed writing intensity obtained by superimposing the fluctuating writing intensity on the constant writing intensity. However, the fluctuating writing intensity is set differently between when the developing bias is changed and when the developing bias is not changed and kept the direct current constant voltage. The reason why the fluctuating writing intensity is set differently is as follows. That is, writing the latent image on a portion to be written on the latent image carrier slightly changes the optical sensitivity at the peripheral portion thereof. Because this causes a change of the fluctuation of the developing potential caused by the fluctuation of the writing intensity depending on the image area ratio of the peripheral portion of the portion to be written, changing the writing intensity cannot reduce the image density fluctuation in all gradations. For this reason, it is inevitable to focus on a certain gradation among all the gradations and generate the fluctuation pattern data of the writing intensity with amplitude suitable for the focused certain gradation. Experiments done by the present inventors showed that the focused certain gradation is different between when the developing bias, the charging bias, and the writing intensity are changed and when only the writing intensity is changed.

Specifically, as described above, when the controller 110 executes all fluctuation controls, the writing intensity is changed to reduce the new image density fluctuation described above. The experiments done by the present inventors showed the new image density fluctuation occurs remarkably at the gradation whose area coverage modulation ratio is 70%. Therefore, generating the fluctuation pattern data of the writing intensity with amplitude suitable for the gradation whose area coverage modulation ratio=70% effectively reduces the cyclic image density fluctuation.

On the other hand, the experiments done by the present inventors showed the image density fluctuation which occurs when the developing bias, the charging bias and the writing intensity are not changed is noticeable in the range of the area coverage modulation ratio of 30% to 70%. Therefore, when the controller 110 cyclically changes only the writing intensity, the controller 110 generates the fluctuation pattern data of the writing intensity with amplitude suitable for the gradation whose area coverage modulation ratio=50% that is an intermediate value in the above range. This reduces the image density fluctuation that occurs when the charging bias and the developing bias among the charging bias, the developing bias, and the writing intensity cannot be cyclically changed.

Fourth Aspect

In the fourth aspect, the image forming apparatus such as the copier 500 according to the third aspect includes the circuitry such as the controller 110 which differs the fluctuating charging voltage and the fluctuating developing voltage between when the writing intensity includes the fluctuating writing intensity and when the writing intensity does not include the fluctuating writing intensity. This reduces the image density fluctuation that occurs when the writing intensity cannot be cyclically changed.

Fifth Aspect

In the fifth aspect, the image forming apparatus such as the copier 500 according to the fourth aspect includes the circuitry such as the controller 110 which sets the charging bias including only the direct current charging voltage when the circuitry sets the developing bias including only the direct-current developing voltage. This avoids increase of the image density fluctuation that occurs when the fluctuation of the charging bias unnecessarily changes the background potential despite the absence of the fluctuation of the developing bias that fluctuates the background potential.

Sixth Aspect

In the sixth aspect, the image forming apparatus such as the copier 500 according to any one of the fourth and fifth aspect includes the charger 70 with the charging roller 71 and reduces the image density fluctuation with the rotation cycle of at least one of the latent image bearer such as the photoconductor 20, the developing sleeve 81, and the charging roller 71. This reduces the image density fluctuation with the rotation cycle of at least of the latent image bearer such as the photoconductor 20, the developing sleeve 81, and of the charging roller 71.

Seventh Aspect

In the seventh aspect, the image forming apparatus such as the copier 500 according to the sixth aspect includes a sensor such as the reflective photosensor 151 to detect an image density fluctuation in a test image. In the seventh aspect, the developing sleeve 81 to which the direct current developing voltage is applied forms a first test image, the sensor detects the image density fluctuation in the first test image, the circuitry such as the controller 110 generates first pattern data of the fluctuating developing voltage based on the image density fluctuation in the first test image, the developing sleeve 81 supplied with the direct current developing voltage and the fluctuating developing voltage fluctuated based on the first pattern data forms a second test image after the charger 70 supplied with the direct current charging voltage charges the latent image bearer such as the photoconductor 20, the sensor detects the image density fluctuation in the second test image, the circuitry generates second pattern data of the fluctuating charging voltage based on the image density fluctuation in the second test image, the developing sleeve 81 supplied with the direct current developing voltage and the fluctuating developing voltage fluctuated based on the first pattern data forms a third test image after the charger 70 supplied with the direct current charging voltage and the fluctuating charging voltage fluctuated based on the second pattern data charges the latent image bearer such as the photoconductor 20, the sensor detects the image density fluctuation in the third test image, and the circuitry generates third pattern data of the fluctuating writing intensity based on the image density fluctuation in the third test image. The image forming apparatus according to the seventh aspect has the first pattern data of the fluctuating developing bias that effectively reduces the image density fluctuation in the solid image portion and the second pattern data of the fluctuating charging voltage that effectively reduces the image density fluctuation in the halftone image portion caused by the fluctuating developing voltage. Additionally, the image forming apparatus according to the seventh aspect has the third pattern data of the fluctuating writing intensity that effectively reduces the image density fluctuation in the high image density portion caused by the fluctuating charging voltage.

Eighth Aspect

In the eighth aspect, the image forming apparatus such as the copier 500 according to the seventh aspect uses the second test image with an image density lower than an image density of the first test image. The image forming apparatus according to the eighth aspect accurately generates the first pattern data of the fluctuating developing bias that effectively reduces the image density fluctuation in the solid image portion and the second pattern data of the fluctuating charging voltage that effectively reduces image density fluctuation in the halftone image portion caused by the fluctuating developing voltage.

Ninth Aspect

In the ninth aspect, the image forming apparatus according to any one of the seventh aspect and the eighth aspect includes the test image whose length in a rotation direction of the latent image bearer is longer than a circumferential length of at least one of the latent image bearer such as the photoconductor 20, the developing sleeve 81, and the charging roller 71. This makes it possible to average the readings of the image density fluctuations in a plurality of rotations and generate each type of the pattern data accurately.

Tenth Aspect

In the tenth aspect, the circuitry of the image forming apparatus according to the seventh aspect to ninth aspect generates at least one of the first pattern data, the second pattern data, and the third pattern data when at least one of the latent image bearer such as the photoconductor 20, the developing sleeve 81, and the charging roller 71 is replaced. Replacement of the latent image bearer, the developing sleeve, or the charging roller may make the pattern data unsuitable and increase the image density fluctuation. The image forming apparatus according to the tenth aspect can avoid such disadvantage.

It is to be noted that the above embodiment is presented as examples to realize the present disclosure, and it is not intended to limit the scope of the disclosure. These novel embodiments can be implemented in various other forms, and various omissions, substitutions, and changes can be made without departing from the gist of the disclosure. These embodiments and variations are included in the scope and gist of the disclosure and are included in the disclosure described in the claims and the equivalent scope thereof.

Each of the functions of the described embodiments may be implemented by one or more processing circuits. A processing circuit includes a programmed controller, as a controller includes circuitry. A processing circuit also includes devices such as an application specific integrated circuit (ASIC), a digital signal controller (DSP), a field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a latent image bearer;

a charger configured to charge a surface of the latent image bearer with a superimposed charging bias obtained by superimposing a fluctuating charging voltage to reduce an image density fluctuation on a direct current charging voltage;

a writing device configured to write a latent image on the surface of the latent image bearer with a superimposed writing intensity obtained by superimposing a fluctuating writing intensity to reduce an image density fluctuation on a constant writing intensity and to write a latent image on the surface of the latent image bearer with the constant writing intensity;

a developing sleeve to which a superimposed developing bias obtained by superimposing a fluctuating developing voltage to reduce an image density fluctuation on a direct current developing voltage is applied to develop the latent image with developer and to which the direct current developing voltage is applied; and circuitry configured to:

control the superimposed charging bias, the superimposed writing intensity, and the superimposed developing bias, and control the fluctuating charging voltage and the fluctuating developing voltage such that the fluctuating charging voltage and the fluctuating developing voltage when the writing device writes the latent image with the superimposed writing intensity are different from the fluctuating charging voltage and the fluctuating developing voltage when the writing device writes the latent image with the constant writing intensity.

2. The image forming apparatus according to claim 1, further comprising a sensor to detect an image density fluctuation in a test image, wherein the developing sleeve to which the direct current developing voltage is applied forms a first test image, the sensor is configured to detect an image density fluctuation in the first test image, the circuitry is configured to generate first pattern data of the fluctuating developing voltage for when the writing device writes the latent image with the superimposed writing intensity and second pattern data of the fluctuating developing voltage for when the writing device writes the latent image with the constant writing intensity based on the image density fluctuation in the first test image detected by the sensor, the developing sleeve to which the superimposed developing bias is applied forms a second test image, the sensor is configured to detect an image density fluctuation in the second test image, and the circuitry is configured to generate third pattern data of the fluctuating charging voltage for when the writing device writes the latent image with the superimposed writing intensity and fourth pattern data of the fluctuating charging voltage for when the writing device writes the latent image with the constant writing intensity based on the image density fluctuation in the second test image detected by the sensor.

3. The image forming apparatus according to claim 2, wherein the charger includes a charging roller, and a cycle of the image density fluctuation is based on at least one of rotation cycles of the latent image bearer, the developing sleeve, and the charging roller.

4. The image forming apparatus according to claim 3, wherein an image density of the second test image is lower than an image density of the first test image.

5. The image forming apparatus according to claim 3, wherein a length of the test image in a rotation direction of the latent image bearer is longer than a circumferential length of at least one of the latent image bearer, the developing sleeve, and the charging roller.

6. The image forming apparatus according to claim 3, wherein the circuitry is configured to generate at least one of the first pattern data, the second pattern data, the third pattern data, and the fourth pattern data when at least one of the latent image bearer, the developing sleeve, and the charging roller is replaced.

7. The image forming apparatus according to claim 2, wherein the second pattern data is a modification of the first pattern data, and the fourth pattern data is a modification of the third pattern data.

8. The image forming apparatus according to claim 7, wherein the second pattern data is obtained by multiplying the first pattern data by a predetermined gain that is a factor less than one.

9. The image forming apparatus according to claim 7, wherein the second pattern data is obtained by reducing an amplitude of each phase in a bias fluctuation waveform corresponding to one cycle indicated by the first pattern data at a fixed ratio.

10. The image forming apparatus according to claim 7, wherein the fourth pattern data is obtained by multiplying the third pattern data by a predetermined gain that is a factor less than one.

* * * * *